US005385479A

United States Patent [19]

Okada

[11] Patent Number: 5,385,479

[45] Date of Patent: Jan. 31, 1995

[54] MODULAR JACK

[75] Inventor: Masanobu Okada, Nagaokakyo, Japan

[73] Assignee: Murata Mfg. Co., Ltd., Kyoto, Japan

[21] Appl. No.: 160,253

[22] Filed: Dec. 2, 1993

Related U.S. Application Data

[63] Continuation-in-part of Ser. No. 103,443, Aug. 6, 1993, abandoned.

[30] Foreign Application Priority Data

| | | | |
|---|---|---|---|
| Aug. 10, 1992 | [JP] | Japan | 4-212599 |
| Aug. 11, 1992 | [JP] | Japan | 4-213996 |
| Aug. 11, 1992 | [JP] | Japan | 4-214042 |
| Dec. 2, 1992 | [JP] | Japan | 4-322879 |

[51] Int. Cl.[6] ..... H01R 13/447

[52] U.S. Cl. ..... 439/144; 439/142

[58] Field of Search ..... 439/142, 144

[56] References Cited

U.S. PATENT DOCUMENTS

| | | | |
|---|---|---|---|
| 4,911,646 | 3/1990 | Marson et al. | 439/144 |
| 5,183,404 | 2/1993 | Aldous et al. | 439/55 |

OTHER PUBLICATIONS

NEC PC-9801N-Col-US.

*Primary Examiner*—Gary F. Paumen

*Attorney, Agent, or Firm*—Spensley Horn Jubas & Lubitz

[57] ABSTRACT

A modular jack applicable to a flat assembly. A hole is pierced in a flat member and a cover that can be opened and closed is disposed so as to cover an opening of the hole. When a modular plug is inserted into the hole, the cover is opened; when not, the cover is closed. When the cover is closed, it is housed in the opening, and the modular jack equals the flat member substantially in thickness. When the modular plug is inserted into the hole through the opening with the cover open, the insertion direction of the modular plug is regulated by inner walls of the hole. When the tip of the modular plug abuts against a bottom portion of the hole, the modular plug cannot be inserted any more. In the state, an electrode section located in the hole is electrically connected to electrodes of the modular plug. A hook portion disposed in the cover locks the modular plug so as to prevent the modular plug from easily dropping out of the modular jack even if the modular plug is pulled. If the cover is provided with a lock/release mechanism, the cover can be opened or closed through single finger motion.

26 Claims, 27 Drawing Sheets

MODULAR JACK

CROSS-REFERENCE TO RELATED APPLICATION

This is a continuation-in-part of application Ser. No. 08/103,443, filed on Aug. 6, 1993, now abandoned.

BACKGROUND OF THE INVENTION

1. Field of the Invention

This invention relates to improvements in a modular jack used for connection of a modem or the like to a telephone line or the like.

2. Description of the Related Art

In recent years, flat packaged electronic assemblies such as IC cards have been used widely. To build circuitry such as a modem in such an assembly, a modular jack must be used for connection of the circuitry to a telephone line or the like.

FIG. 20 shows a structure example of a conventional IC card, wherein an IC card 10 is an IC card in which a modem is incorporated. For connection of the internal modem to an external system, a modular jack 12 is disposed at one end of the IC card 10. For example, the modem can be connected to a telephone line by inserting a modular plug 14 connected to the telephone line into the modular jack 12. Further, if the IC card is mounted on external equipment, such as a personal computer, the external equipment can be connected to a telephone line while the IC card 10 is used as a modem.

FIG. 21 shows the structual form of the modular plug 14 connected to the IC card 10 shown In FIG. 20; FIG. 22A shows a front view of the modular jack 12; and FIG. 22B shows a sectional view taken on line A—A of FIG. 22A.

The modular jack 12 has the basic functions of insertion direction regulation, push stop, return stop, and electric connection. The insertion direction regulation function is to regulate the insertion direction of the modular plug 14 to one direction; in the example shown in FIGS. 22A and 22B, the function is provided by inner walls 16 of the modular jack 14. The push stop function is to stop pushing of the modular plug 14 in the insertion direction; in the example shown In FIG. 22A and 22B, the function is provided by a bottom portion 18. The return stop function is to stop movement in the return direction from the insertion direction; in the example shown in FIG. 22A and 22B, the function is provided by hook portions 22 engaged with a lever 20 of the modular plug 14. The push and return stop functions lock the modular plug 14 at a predetermined position. The electric connection function is to electrically connect electrodes of the modular plug 14 to a circuit such as a modem; in the example shown in FIGS. 22A and 22B, the function is provided by electrodes 24 disposed in the modular jack 12.

However, to use the modular jack having the structure at a part or place where there is a limitation on thickness, such as an IC card, the thickness of the modular jack 12 introduces a problem, For example, the portion where the modular jack is installed must be thickened, as shown in FIG. 20, leading to demerits of a complicated form, inconvenience of handling, and an increase in production costs.

SUMMARY OF THE INVENTION

Accordingly, it is an object of the invention to enable a modular jack to be located at a member or place where there is a limitation on thickness without thickening a portion where the modular jack is located.

It is another object of the invention to enable simplification of the form increased ease of handling, reduction in production costs, and prevention of damage caused by handling.

It is a further object of the invention to provide an assembly having a flat form although the assembly contains a modular jack.

It is a fourth object of the invention to prevent the invasion of dusts and the electric shock.

It is a fifth object of the invention to provide an easy-to-handle flat-packaged assembly containing a modular jack particularly when the modular jack is not used.

It is a sixth object of the invention to provide a flat-packaged assembly that can be stored and carried with the same dimensions as a flat-packaged assembly where no modular jack is formed although a modular jack is disposed on the former flat-packaged assembly.

It is a seventh object of the invention to provide a flat-packaged assembly that can protect a modular jack by the flat-packaged assembly itself when no modular plug is attached to the modular jack.

It is an eighth object of the invention to automatically operate new disposed mechanisms for accomplishing the seventh object when a flat-packaged assembly is installed on or removed from an electronic apparatus, thereby improving operability.

To these ends, according to the invention, there is provided a modular jack comprising:

a) a flat member having a hole; and b) a cover that can be opened and closed for covering an opening of the hole, the cover being housed in the opening when it is closed.

The hole includes:

a1) the opening open to one face of the fiat member;

a2) an inner wall for regulating the insertion direction of a modular plug into the hole through the opening;

a3) a bottom portion against which the tip of the modular plug abuts for stopping the modular plug; and a4) an electrode section located in the hole so as to be electrically connected to electrodes of the modular plug when the modular plug is inserted into the hole through the opening.

The cover includes a hook portion for locking the modular plug when the modular plug is inserted into the hole through the opening.

In the invention, the cover can be housed in the hole pierced in the flat member; it can be housed in the opening of the hole. Therefore, when the modular jack is not used, namely, when a modular plug is not attached thereto, the cover may be closed. When the modular jack is used, the cover may be opened for inserting a modular plug into the hole through the opening. The basic functions of the modular jack are provided by the hole and the cover. That is, the insertion direction regulation function is provided by the inner wall of the hole; the push stop function is provided by the bottom portion of the hole; the return stop function is provided by the hook portion of the cover; and the electric; connection function is provided by the electrode section in the hole.

Therefore, in the invention, the flat member is used to provide the modular jack. Since a modular plug is inserted into the hole on one surface of the flat member, the portion where the modular jack is located, such as the end portion of the flat member, need not be thickened. Therefore, an assembly having a flat form although it contains a modular jack can be provided; the modular jack applicable to the flat member can be provided. As a result, the forms of the modular jack and the flat member containing the same, such as an IC card, can be simplified; the modular jack and flat member can be handled easily; and production costs thereof can be reduced. In addition, the cover prevents the occurrence of the accidents, such as an invasion of the dusts into the hole, electric shocks on the operator's finger caused by touching the electrodes in the hole, etc.

The modular jack of the invention can also be provided as a structure that can hold the state in which the cover is open or the state in which the cover is closed.

For example, the flat member is fixed and is formed with first and second projection and the cover is attached to the flat member so as to pivot and is also formed with third projections. When the cover is open, the first projection and the third projection are hooked onto each other to hold the cover in the open state. When the cover is closed, the second projection and the third projection are hooked onto each other to hold the cover closed state.

Such a structure realizes ease of handling and prevention of damage caused by handling without a remarkable complication of the structure. That is, since the user can insert a modular plug without supporting the cover with his or her finger, handling is facilitated and since the cover is not opened suddenly during transportation, etc., the cover, etc., can be prevented from being damaged.

Such an effect can also be produced by replacing the first and second projections with first and second recesses. It can also be produced by replacing the third projection with a third recess. In these modifications, one of the projections is fitted into the recess, thereby maintaining the cover state.

The modular jack can also be provided as a structure which enables the cover to be opened or closed through a single finger motion. For example, a lock/release mechanism may be installed for holding the cover in the open state or holding the cover in the closed state, and for opening the cover to make the transition to the cover open state if a user depresses the cover surface when the cover is closed. Such a mechanism realizes ease of handling and prevention of damage caused by handling without a remarkable complication of the structure. That is, since the user can insert a modular plug without supporting the cover with his or her finger, handling is facilitated and since the cover is not opened suddenly during transportation, etc., the cover, etc., can be prevented from being damaged, in addition, the cover can be opened or closed through a single finger motion, thus operability is remarkably improved.

The lock/release mechanism can be made of first and second pivots, spring means, and guide means. The first and second pivots are concentric with each other derived from the cover and are integral with the cover. The spring means exerts a force in the cover opening direction around the first pivot. The spring means can be provided by a spring wound on the first pivot and fixed on the flat member. The guide means guides the position of the cover in response to the rotation of the cover around the second pivot. The guide means can be provided by a movable member having a pin and a fixed member having a guide groove.

A more detailed description is given below: First, the movable member is a member which is disposed so as to be movable along the extension direction of the second pivot and turns around the second pivot as the cover turns around the second pivot. A pin is disposed on the circumference of the movable member. The guide groove is disposed on the fixed member formed on or fixed to the flat member for receiving and guiding the pin. Therefore, the cover movement around the second pivot is guided by the guide groove. The guide groove includes at least two stable holding points for holding the pin at a predetermined position unless a force repelling a cover force exerted by the spring means is applied to the cover. The stable holding points correspond to the cover open state and the cover closed state. Therefore, the cover open or closed state is held appropriately.

Electro-magnetic shielding performance can be secured by installing a conductive member for covering at least the circumference of the hole. Good electric connection performance can be provided by making the electrode section springy.

According to the invention, there is provided a modified form of modular jack comprising:

a) a flat member having a housing; and b) a cover housed in the housing when the cover is closed; and c) means for stopping returning of the modular plug in the insertion direction.

The housing has means for regulating the insertion direction of a modular plug, means for stopping the tip of the modular plug, and means for electrically connecting to electrodes of the modular plug. The modular jack equals the flat member substantially in thickness when the cover is housed in the housing.

Due to its form, the housing of the flat member provides the insertion direction regulation, push stop, and electric connection functions, and the cover provides the return stop function. Further, when the cover is housed in the housing the modular jack equals the flat member substantially in thickness. Therefore, a modular jack appropriate for installation in a flat assembly can be provided, namely, a modular jack that can be installed in a flat member without thickening a portion of the flat member can be provided.

According to the invention, there is provided a flat packagd assembly comprising:

a) a modular jack including:

a1) a flat member having a housing mechanism; the housing mechanism having means for regulating the insertion direction of a modular plug, means for stopping the tip of the modular plug, and means for electrically connecting to electrodes of the modular plug; and a2) a cover housed in the housing mechanism when the cover is closed; and a3) means for stopping returning of the modular plug in the insertion direction; and b) a circuit incorporated in the flat member;

The modular jack equals the flat member substantially in thickness when the cover is housed in the housing mechanism.

The flat member can be formed like a leaf. In this case, preferably the modular jack is disposed at the joint portion of the leaf. In addition, conductive plates for electromagnetically shielding the incorporated circuit from the outside and also casing the flat member may be installed. The electric connection means is connected via the flat member to the incorporated circuit.

According to the invention, there is provided a flat-packaged assembly comprising:

A. a modular jack having:

a) a flat member having a hole; the hole including:

a1) an opening open to one face of the flat member;

a2) at least one inner wall for regulating an insertion direction of a modular plug into the hole through the opening;

a3) a bottom portion against which a tip of the modular plug abuts for stopping the modular plug; and a4) an electrode section located in the hole so as to be electrically connected to electrodes of the modular plug when the modular plug is inserted into the hole through the opening; and b) a cover that can be opened and closed for covering the opening of the hole, the cover being housed In the opening when it is closed; the cover including a hook portion for locking the modular plug when the modular plug is inserted into the hole through the opening; and B. a frame member for housing the flat member so that it can be drawn out from and pushed into the frame member when the cover is closed; when the frame member houses the flat member, at least the modular jack being covered with the frame member.

Therefore, in the invention, the drawer structure made up of the flat member and the frame member enables the flat modular jack to be housed within the frame member. Resultantly, when the modular jack is not used, handling the flat-packaged assembly is made easy, and the modular jack can be protected by the flat-packaged assembly itself. When the flat-packaged assembly is not used, for example, when it is stored or carried, the dimensions of the flat-packaged assembly equal those of an assembly where no modular jack is formed although a modular jack is disposed on the flat-packaged assembly of the invention. In addition, even if strict standard dimensions are required for the frame, the standard can be met.

In the invention, the flat member can be made of two case members. Preferably, these case members are made flat. These are bonded to each other with adhesives or engaged with each other for fixing so that one face of one case member is opposed to one face of the other. Under such structure, the hole and cover can be formed In one case member, and the bottom portion can be formed by using one face of the other case member.

Further, the flat-packaged assembly of the invention can be embodied as a structure to enable the user to draw the flat member to or push it into the frame member through single finger motion, as a structure to enable the user to open or close the cover through single finger motion, or as a very convenient and automatic structure to enable the user to perform both actions through single finger motion.

To do this, a second lock/release mechanism having the following members may be disposed:

a) a spring mechanism for holding a first state and a second state and making the automatic state transition from the first to second state or from the second to first state in response to operation of the user, the first state being the state in which a first portion of the flat member where at least the modular jack is disposed is drawn out to the outside of the frame member; the second state being the state in which the first portion is in the inside of the frame member; the operation of the user for causing the transition to be made being operation of applying push pressure in the pushing into direction of the flat member with respect to the frame member to the flat member, and b) an opening/closing mechanism for automatically opening the cover Just after the first portion is drawn out to the outside of the frame member and for automatically closing the cover just before the first portion is pushed into the inside of the frame member.

Preferably, the flat member has at least one second portion as a guide for drawing out the flat member from the frame member and pushing the flat member into the frame member In addition to the first portion described above. In this case, the spring mechanism is disposed at the tip of the second portion. Preferably, the spring mechanism has two springs and a guide groove. The first end of the first spring is fixed to the frame member and the second end is fixed to the tip of the second portion. The first end of the second spring is fixed to the second portion and the second end moves idly on the side of the first portion when viewed from the first spring. The guide groove is provided for guiding the idle movement of the second spring. More particularly, the guide groove has a first stop position for holding the second end of the second spring so that the first state is held a second stop position for holding the second end of the second spring so that the second state is held, and at least one path to make the transition from the first to second state and from the second to first state.

The opening/closing mechanism can be made of one spring and one wire. The first end of the spring is fixed to the first portion and the second end is fixed to the cover. The function of the opening/closing mechanism is to energize In the direction of closing the cover. The First end of the wire is fixed to the cover and the second end is fixed to the frame member or a member fixed to the frame member, such as a circuit board on which electric circuitry is mounted. The function of the wire is to pull in the direction of opening the cover.

DESCRIPTION OF THE PREFERRED EMBODIMENTS

Figure 1A:
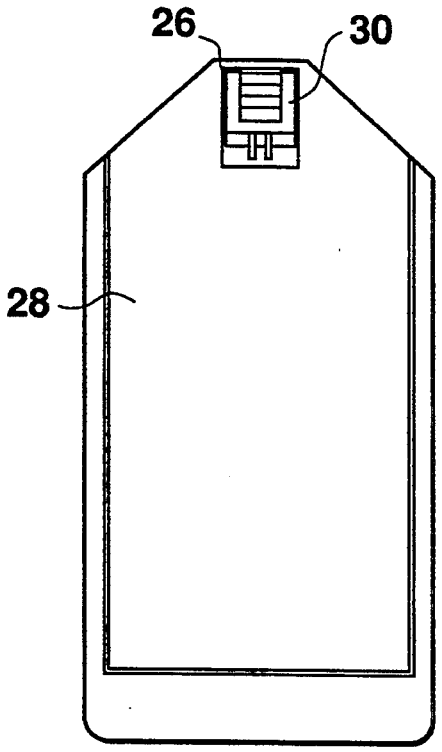
FIG. 1A is a top view of an IC card having a modular jack according to a first embodiment of the invention, and particularly shows the state before a modular plug is attached to the modular jack.

Referring now to the accompanying drawings, there are shown preferred embodiments of the invention.

Parts identical with or simliar to those previously described with reference to FIGS. 20 to 22B are denoted by the same reference numerals in FIGS. 1A to 19 and 23A to 28B, and will therefore not be discussed again.

First Embodiment

Figure 1B:
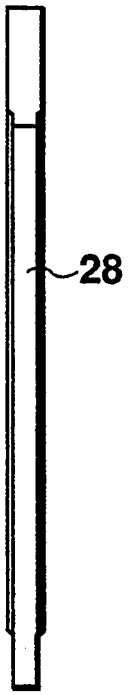
FIG. 1B is a side view of the IC card in FIG. 1A, and particularly shows the state before a modular plug is attached to the modular jack.
Figure 2:
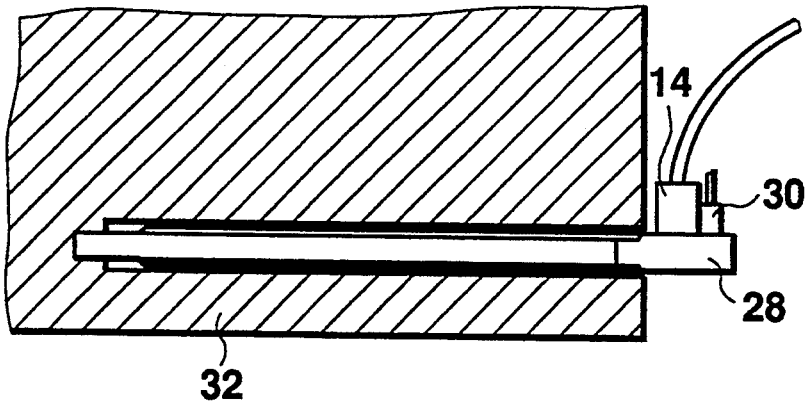
FIG. 2 is a schematic sectional view showing the state in which the IC card in FIG. 1A is installed in an external apparatus and a modular plug is attached to the modular jack.

FIGS. 1A, 1B, and 2 show application forms of a modular jack according to a first embodiment of the invention. Particularly, FIGS. 1A and 1B show the top and side of an IC card before a modular plug is attached to the modular jack according to the first embodiment, and FIG. 2 shows the state in which the IC card is mounted on an external apparatus, such as a personal computer or wordprocessor, and further a modular plug is attached to the modular jack.

First, the modular jack 26 according to the embodiment is located at one end of an IC card 28, as shown in FIG. 1A and 1B. The IC card 28 has a protruding leaf like form where the modular jack is to be disposed. In other words, at the end of otherwise rectangular card 28 which will protrude from an apparatus, the corners of card 28 are chamfered. This eliminates protruding sharp corners which could be a hazard to users and reduces the amount of material required for a card. The modular jack is made flat by a structure as described below. When a cover 30 of the modular jack 26 is closed, the modular jack 26 takes a flat form as shown in FIG. 1B. At the time, the thickness of the modular jack 26 is substantially the same as that of the IC card 28.

To use circuitry contained in the IC card 28, such as a modem, the IC card 28 is installed in an external apparatus 32. At the time, to connect the modem contained in the IC card 28 to a telephone line or the like, the cover 30 of the modular jack 26 must be opened. When the cover 30 of the modular jack 26 is open, a modular plug 14 can be attached to the modular jack 26.

As is apparent from a consideration of FIGS. 1A, 1B and 2, flat member 34 has a rear edge, located at the top in FIGS. 1A and 1B and at the right-hand side of FIG. 2, and two side edges 35 which extend to the rear edge and are oriented to form chamfered corners of the flat member. A portion of flat member 34 which is delimited by the rear edge and side edges 35 will project out of the piece of equipment 32 when the flat member is installed therein. Modular jack 26 is arranged in a hole formed in this portion of flat member 34.

Thus, the invention can provide a thin modular jack that can be located at a place or member where there is a limitation on thickness, such as the IC card 28. The modular jack 26 according to the embodiment has a structure as shown in FIGS. 3A to 5.

Figure 3B:
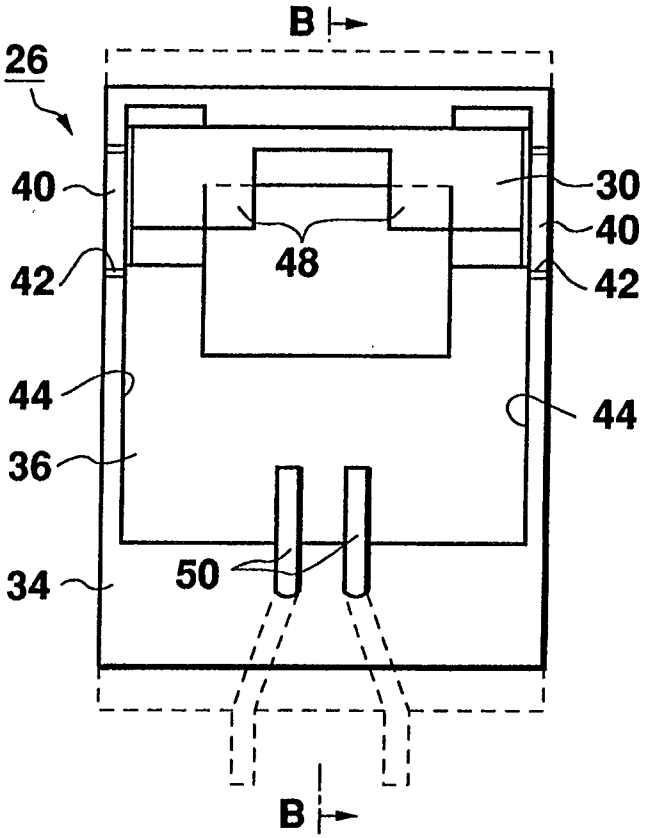
FIG. 3B is a front view of the modular jack according to the first embodiment used with the IC card in FIG. 1A, and particularly shows the state in which the cover is open.
Figure 3A:
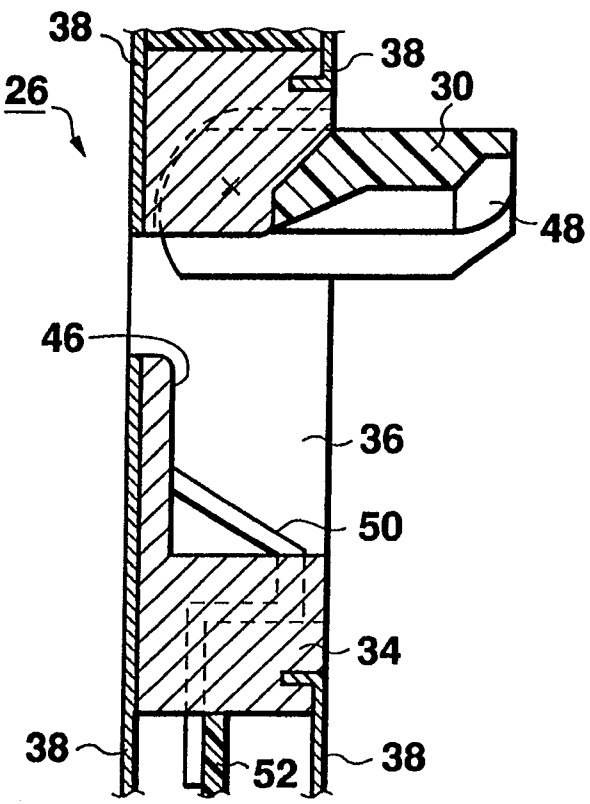
FIG. 3A is a sectional view taken on line B—B of FIG. 3B, and particularly shows the state in which a cover is open.
Figure 4B:
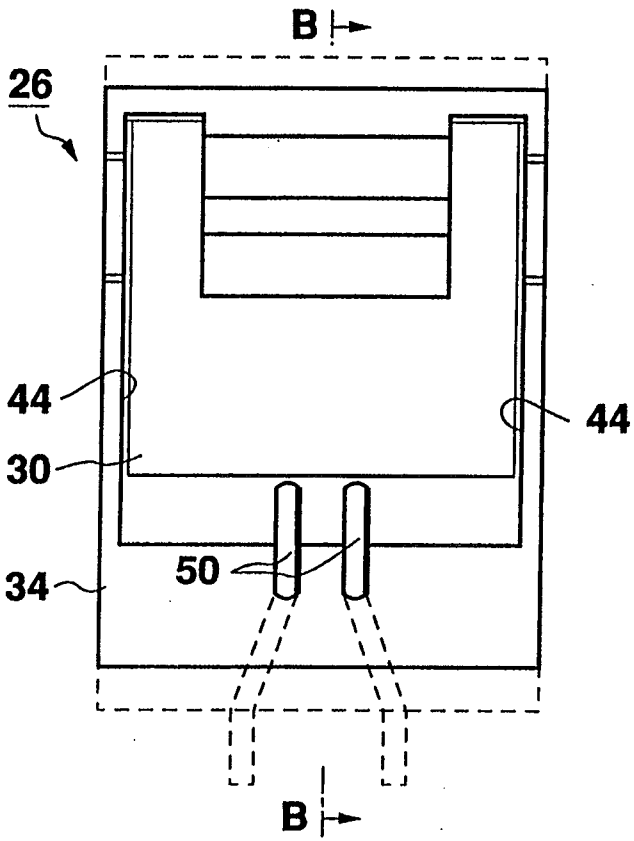
FIG. 4B is a front view of the modular jack in FIGS. 3A and 3B, and particularly shows the state in which the cover is closed.
Figure 4A:
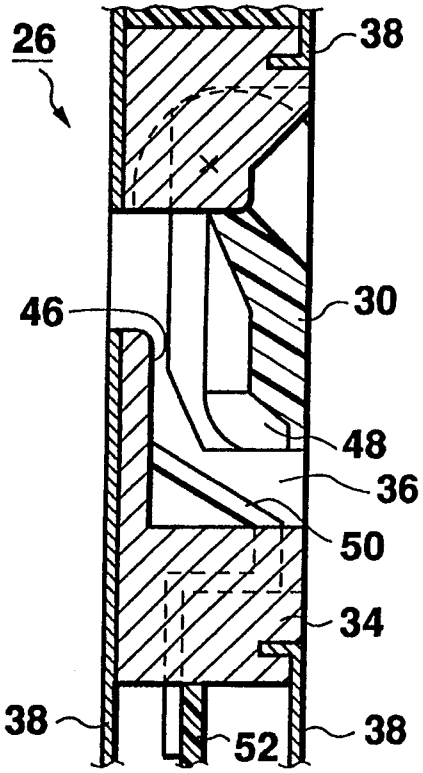
FIG. 4A is a sectional view taken on line B—B of FIG. 4B, and particularly shows the state in which the cover is closed.
Figure 5:
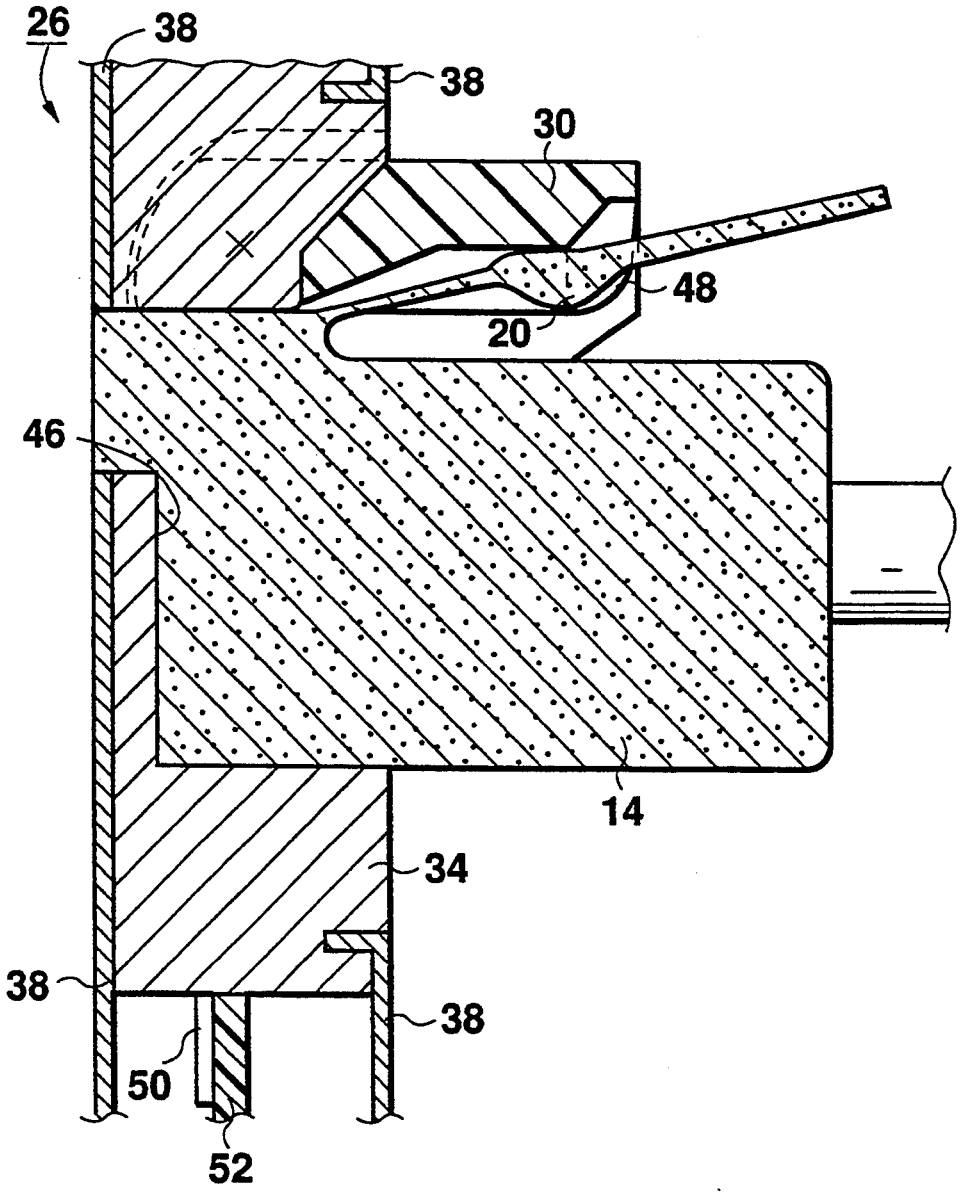
FIG. 5 is a sectional view taken on line B—B of FIG. 3B, and particularly shows the state in which a modular plug is attached to the modular jack.

FIG. 3A shows the section, taken on line B—B of FIG. 3B, of the modular jack 26 when the cover 30 is open. FIG. 3B shows the front of the modular jack 26 when the cover 30 is open. FIG. 4A shows the section taken on line B—B of FIG. 4B when the cover 30 is closed. FIG. 4B shows the front of the modular jack 26 when the cover 30 is closed. FIG. 5 shows the section taken on line B—B of FIG. 3B when the cover 30 is open and the modular plug 14 is attached to the modular jack.

As shown in the figures, the modular jack 26 according to the embodiment is provided with a flat member 34 which is formed with a hole 36 having an opening substantially like a rectangle. The cover 30 is mounted on one of four inner walls of the hole 36. Both the front and back of the peripheries of the modular jack 26 are cased with metal plates 38 which are extended from a flat assembly in which the modular jack 26 is installed, such as the IC card 28. In the figures, the modular jack 26 is integral with the IC card 28. The front and back of the IC card 28 are covered with the metal plates 38 for electromagnetically shielding the circuitry in the IC card 28 from the outside and also casing the IC card 28.

The cover 30 functions as a cover of the hole 36 that can be opened and closed. To enable such a function, the cover 30 is formed with pivots 40 and the flat member 34 is formed with holding portions 42. The pivots 40 are housed in the holding portions 42 and are held by the metal plates 38. Such a structure enables the cover 30 to be turned with the axis indicated by the X mark in the figures as the center.

The basic functions of the modular jack as described above, namely, the insertion direction regulation, push stop, return stop, and electric connection functions are provided as described below:

First, the insertion direction regulation function is provided by inner walls 44 of the hole 36. When the modular plug 14 is inserted into the hole 36 as shown in FIG. 5, the insertion direction is regulated by the inner walls 44.

Next, the push stop function is provided by a bottom portion 46 of the hole 36. As the modular plug 14 is inserted into the hole 36, when it abuts against the bottom portion 46, the modular plug 14 cannot be inserted any further.

Further, the return stop function is provided by two hook portions 48 located at the tip of the cover 30. As the modular plug 14 is inserted into the hole 36, a lever 20 of the modular plug 14 is engaged with the hook portions 48, as shown in FIG. 5. To draw the modular plug 14 out of the modular jack 26, the lever 20 must be depressed. Unless the lever 20 is depressed, the modular plug 14 cannot be drawn out without destruction.

Last, the electric connection function to the modular plug 14 is provided by electrodes 50 drawn from the inner walls 44 of the hole 36. As the modular plug 14 is inserted into the hole 36, electrodes of the modular plug 14 are pressed into contact with the electrodes 50. To hold the contact in a good condition, the electrodes 50 are made of spring material. Other ends of the electrodes 50 are drawn into the IC card 28 through the inside of the flat member 34 for connection to electric wiring on a circuit board 52 in the IC card 28 by soldering or the like.

Thus, according to the embodiment, when the cover 30 is open, the modular plug 14 can be inserted as shown in FIG. 5. When the modular jack 26 is not used, the cover 30 may be closed as shown in FIGS. 4A and 4B.

Adoption of such a structure enables the modular jack 26 to be made thin. As a result, the modular jack 26 can be used with a member whose thickness is limited like the IC card 28 In FIG. 1B without thickening a portion of the member. This leads to simplification of the form of an IC card, etc., increased ease of handling, and a reduction in production costs. In addition, in the embodiment, with the modular plug 14 inserted in the modular jack 26, a portion near the tip of the modular plug 14 does not project beyond the back of the IC card 28. Therefore, the modular jack 26 can be mounted on a place with no dimension margin for the back of the IC card 28, and the appearance of the IC card 28 is not marred. When the modular jack 26 is not used, the cover 30 can be closed, and it thus does not become obstructive to transportation, etc., and it is unlikely to be damaged. In addition, the cover 30 prevents an invasion of dusts into the modular jack 26, an electric shock from the elctrodes 50, etc.

Second Embodiment

Figure 6B:
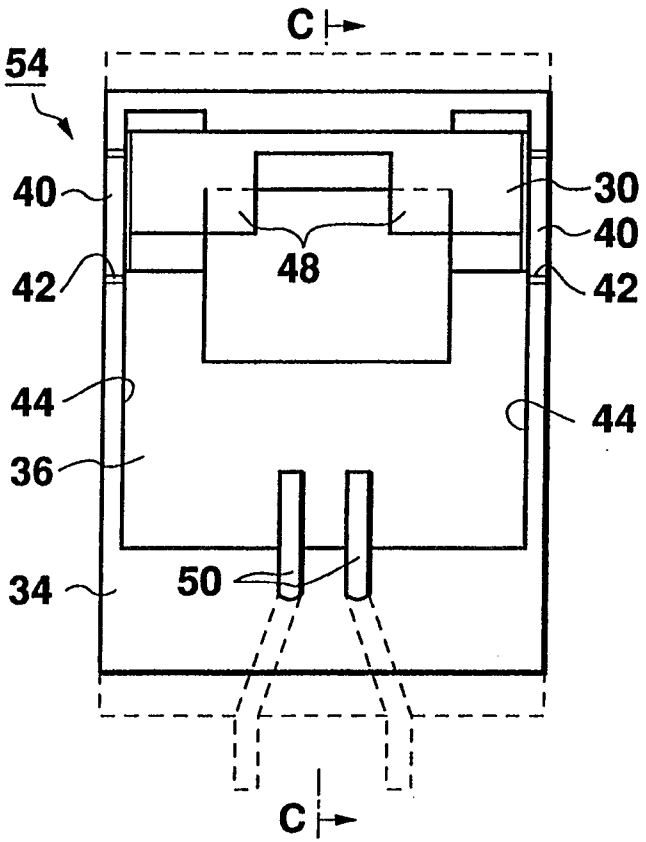
FIG. 6B is a front view of a modular jack according to a second embodiment, and particularly shows the state in which the cover is open.
Figure 6A:
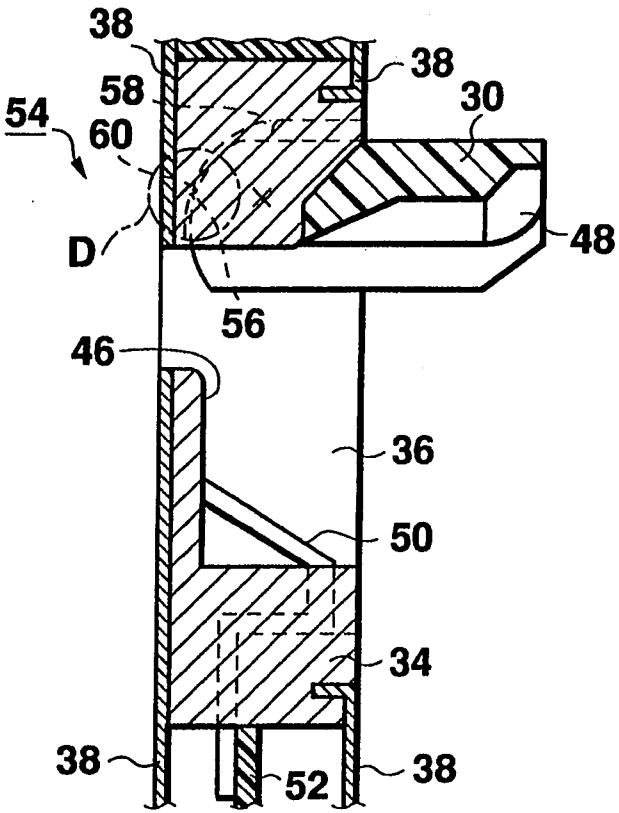
FIG. 6A is a sectional view taken on line C—C of FIG. 6B, and particularly shows the state in which a cover is open.
Figure 7B:
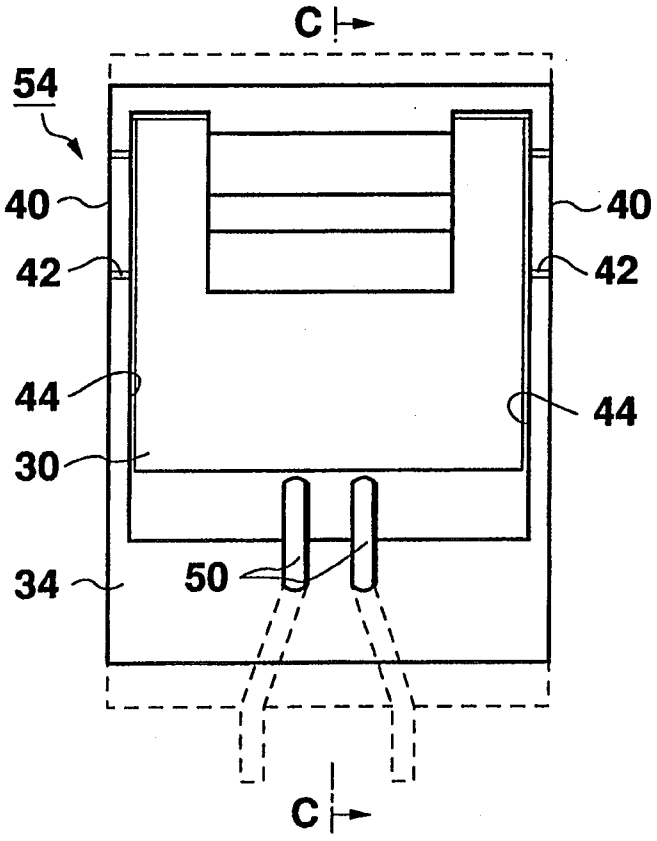
FIG. 7B is a front view of the modular jack in FIG. 6, and particularly shows the state in which the cover is closed.
Figure 7A:
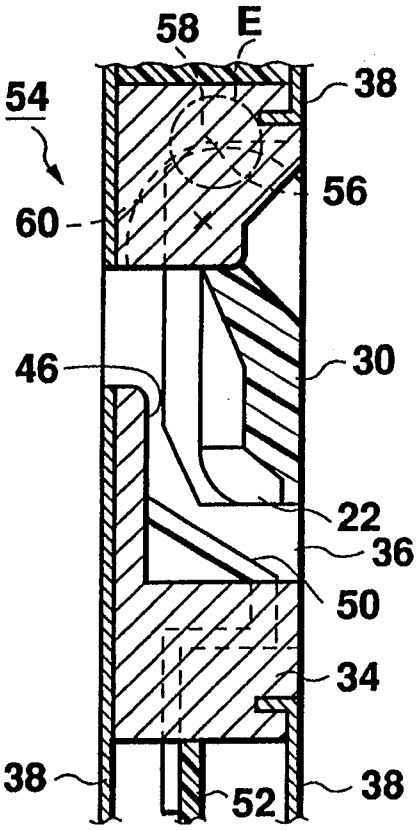
FIG. 7A is a sectional view taken on line C—C of FIG. 7B, and particularly shows the state in which the cover is closed.
Figure 8:
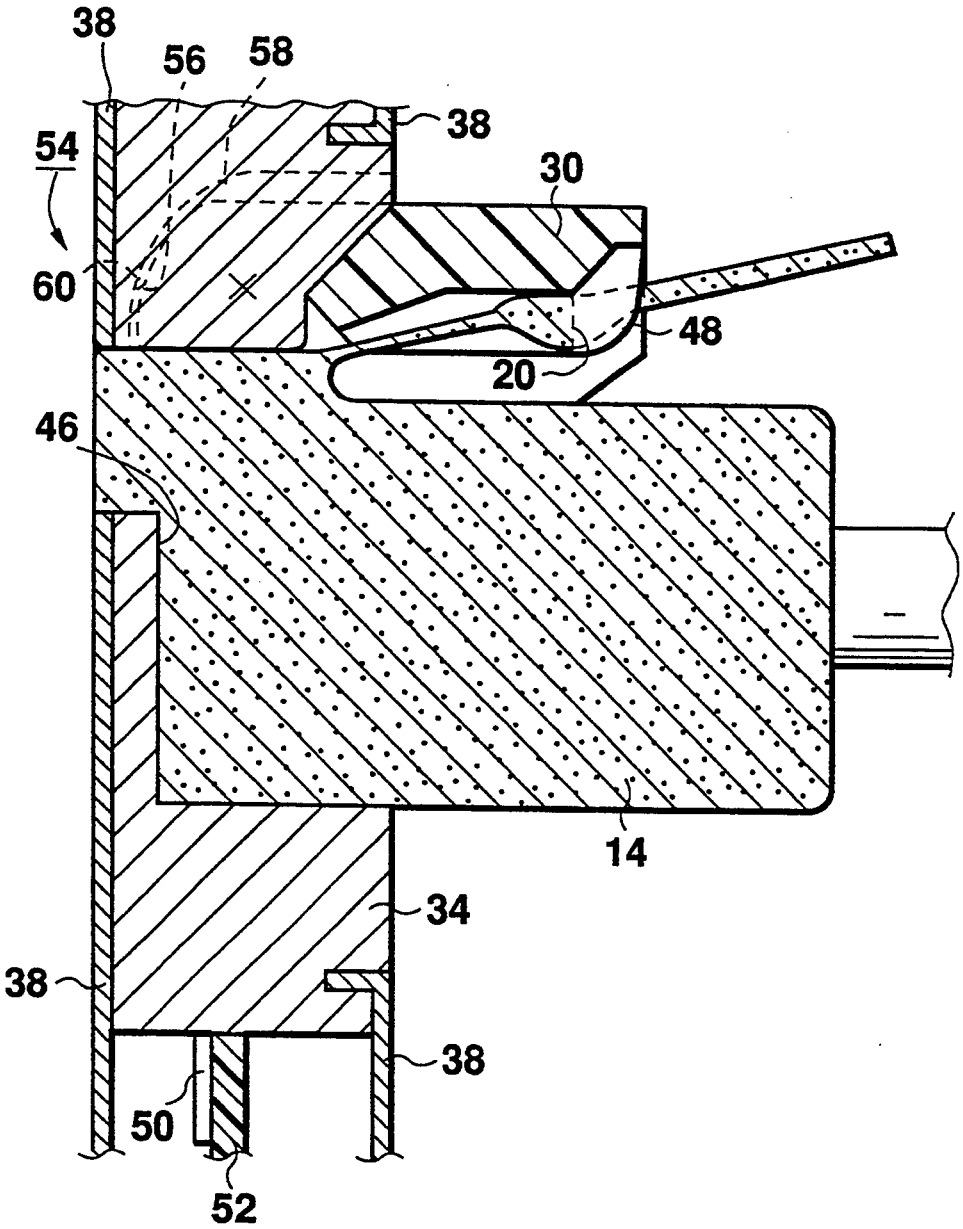
FIG. 8 is a sectional view taken on line C—C of FIG. 6B, and particularly shows the state in which a modular plug is attached to the modular jack.
Figure 9A:
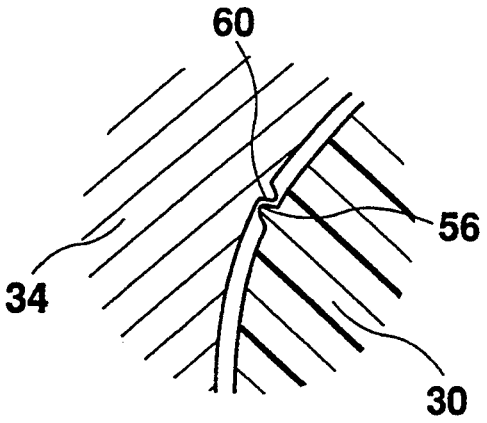
FIG. 9A is a detailed sectional view in circle D shown in FIG. 6A.
Figure 9B:
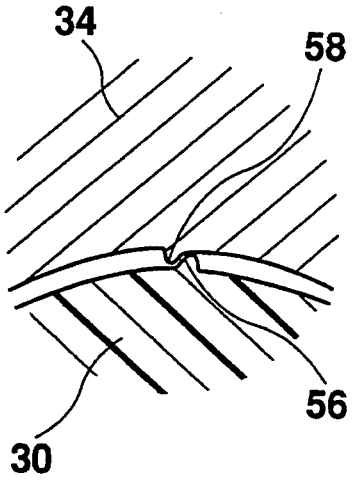
FIG. 9B is a detailed sectional view in circle E shown in FIG. 7A.

Next, the structure of a modular jack according to a second embodiment of the invention will be described. FIGS. 6A to 9B show the structure of the modular jack 54 according to the second embodiment of the invention. FIG. 6A shows the section, taken on line C—C of FIG. 6B, of the modular jack 54 when a cover 30 is open. FIG. 6B shows the front of the modular jack 54 when the cover 30 is open. FIG. 7A shows the section taken on line C—C of FIG. 7B when the cover 30 is closed. FIG. 7B shows the front of the modular jack 54 when the cover 30 is closed. FIG. 8 shows the section taken on line C—C of FIG. 6B when the cover 30 is open and a modular plug 14 is attached to the modular jack. FIG. 9A shows a detailed sectional structure in circle D shown in FIG. 6A. FIG. 9B shows a detailed sectional structure in circle E shown in FIG. 7A. Parts identical with or similar to those previously described in the first embodiment are denoted by the same reference numerals in the second embodiment and will therefore not be discussed again.

The modular jack according to the second embodiment differs from the modular jack according to the first embodiment in that the cover 30 is formed with an engagement projection 56 and a flat member 34 is formed with engagement projections 58 and 60. When the cover 30 is open, the engagement projections 56 and 60 are engaged with each other to fix the position of the cover 30, as shown in FIGS. 6A and 9A. When the cover 30 is closed, the engagement projections 56 and 58 are engaged with each other to fix the position of the cover 30, as shown in FIGS. 7A and 9B. Such a structure in the second embodiment prevents an accident in which when the IC card is transported, the cover 30 jumps and collides with another object and is damaged, for example. Further, when the modular plug 14 is attached to the modular jack 54, an action such as depressing the cover 30 with a finger is not needed, thus the operability of the modular jack 54 is improved.

Third Embodiment

Figure 10A:
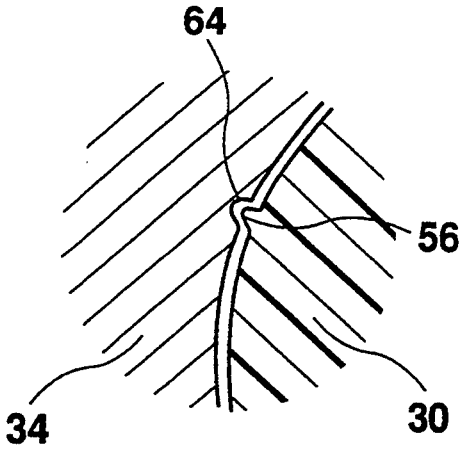
FIG. 10A is a detailed sectional view in circle D of a modular jack according to a third embodiment of the invention.
Figure 10B:
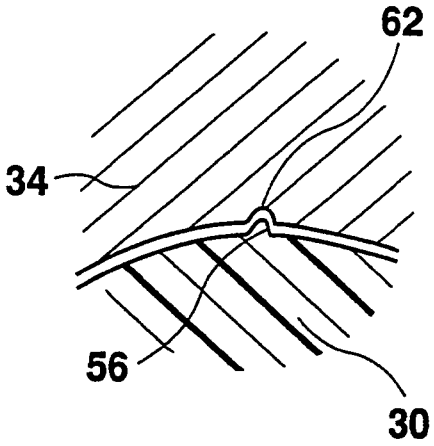
FIG. 10B is a detailed sectional view in circle E of the modular jack according to the third embodiment of the invention.

Next, the structure of a modular jack according to a third embodiment of the invention will be described. FIGS. 10A and 10B show the structure of the modular jack according to the third embodiment of the invention. FIG. 10A shows a detailed sectional structure in circle D shown in FIG. 6A. FIG. 10B shows a detailed sectional structure in circle E shown in FIG. 7A. Parts identical with or similar to those previously described in the first or second embodiment are denoted by the same reference numerals in the third embodiment and will therefore not be discussed again.

The modular jack according to the third embodiment differs from the modular jack according to the second embodiment in the structures in circles D and E. The third embodiment uses engagement recesses 62 and 64 in place of the engagement projections 58 and 60 in the second embodiment respectively. When a cover 30 is open, an engagement projection 56 is engaged with the engagement recess 64 to fix the position of the cover 30, as shown in FIG. 10A. When the cover 30 is closed, the engagement projection 56 is engaged with the engagement recess 62 to fix the position of the cover 30, as shown in FIG. 10B. Therefore, the third embodiment also produces a similar effect to that in the second embodiment.

Fourth Embodiment

Figure 11A:
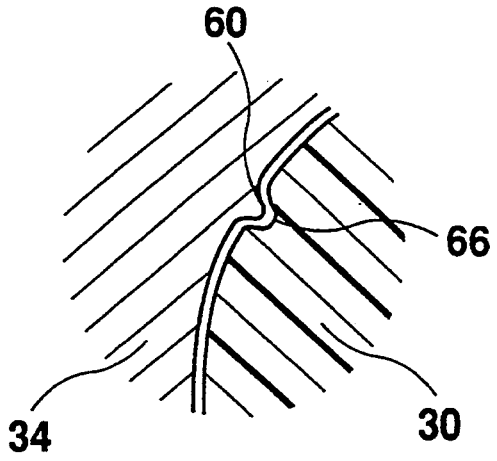
FIG. 11A is a detailed sectional view in circle D of a modular jack according to a fourth embodiment of the invention.
Figure 11B:
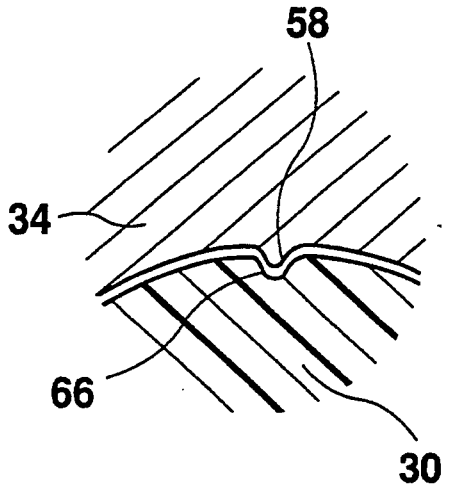
FIG. 11B is a detailed sectional view in circle E of the modular jack according to the fourth embodiment of the invention.

Next, the structure of a modular jack according to a fourth embodiment of the invention will be described. FIGS. 11A and 11B show the structure of the modular jack according to the fourth embodiment of the invention. FIG. 11A shows a detailed sectional structure in circle D shown in FIG. 6A. FIG. 11B shows a detailed sectional structure In circle E shown in FIG. 7A. Parts identical with or similar to those previously described in the first to third embodiments are denoted by the same reference numerals in the fourth embodiment and will therefore not be discussed again.

The modular jack according to the fourth embodiment differs from the modular .lack according to the second embodiment .in the structures in circles D and E. The fourth embodiment uses an engagement recess 66 in place of the engagement projection 56 in the second embodiment. When a cover 30 is open, the engagement recess 66 is engaged with an engagement projection 58 to fix the position of the cover 30, as shown in FIG. 11A. When the cover 30 is closed, the engagement recess 66 is engaged with the engagement projection 58 to fix the position of the cover 30, as shown in FIG. 11B. Therefore, the fourth embodiment also produces a similar effect to that in the second embodiment.

Fifth Embodiment

Figure 12B:
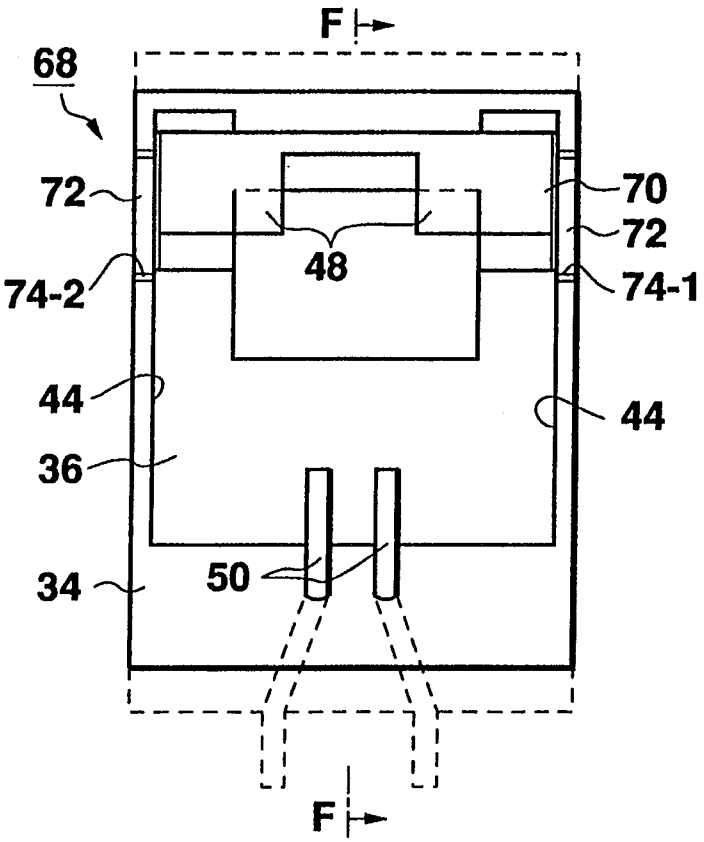
FIG. 12B is a front view of a modular jack according to a fifth embodiment of the invention, and particularly shows the state in which the cover is open.
Figure 12A:
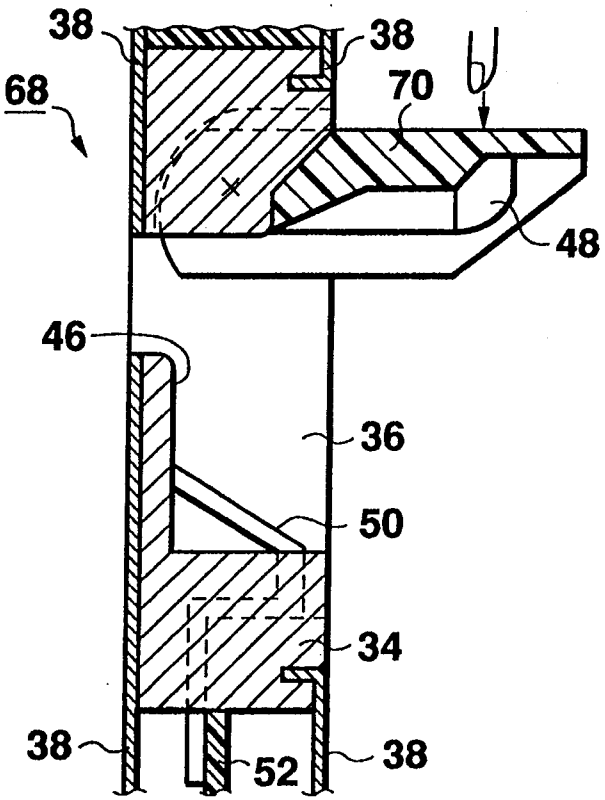
FIG. 12A is a sectional view taken on line F—F of FIG. 12B, and particularly shows the state in which a cover is open.
Figure 13B:
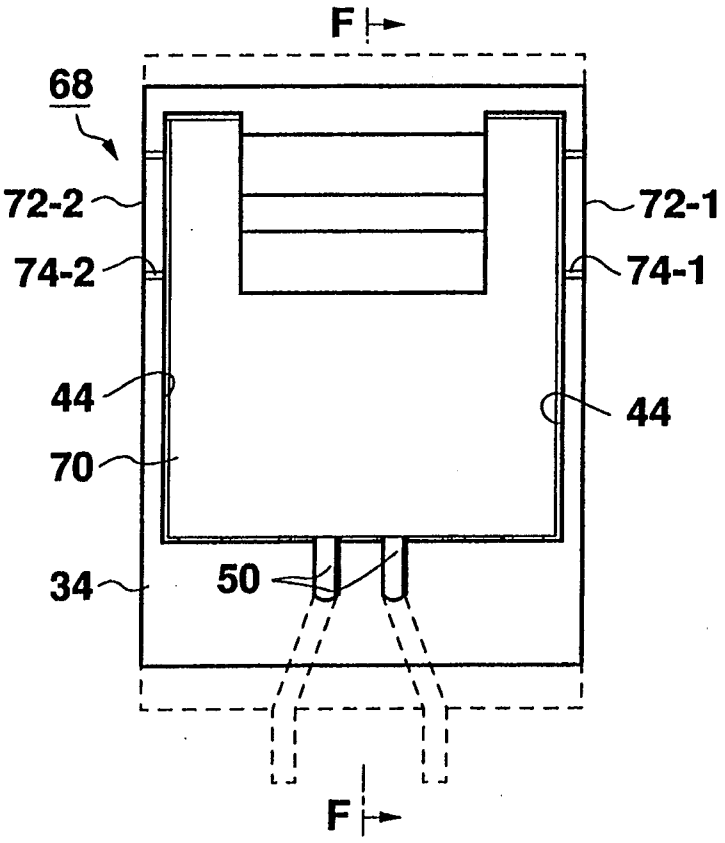
FIG. 13B is a front view of the modular jack in FIG. 12A, and particularly shows the state in which the cover is closed.
Figure 13A:
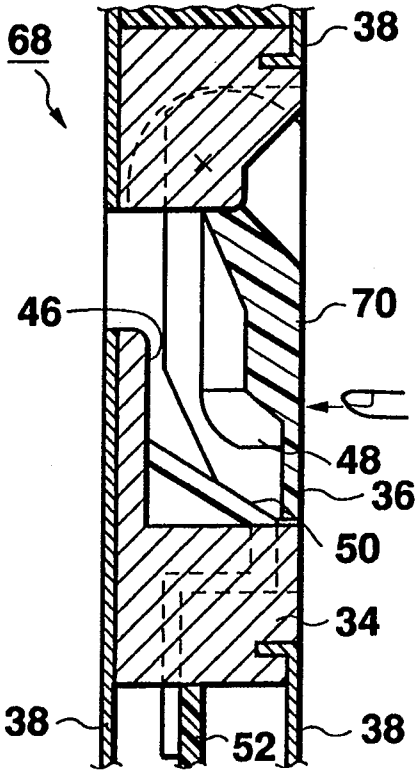
FIG. 13A is a sectional view taken on line F—F of FIG. 13B, and particularly shows the state in which the cover is closed.
Figure 14:
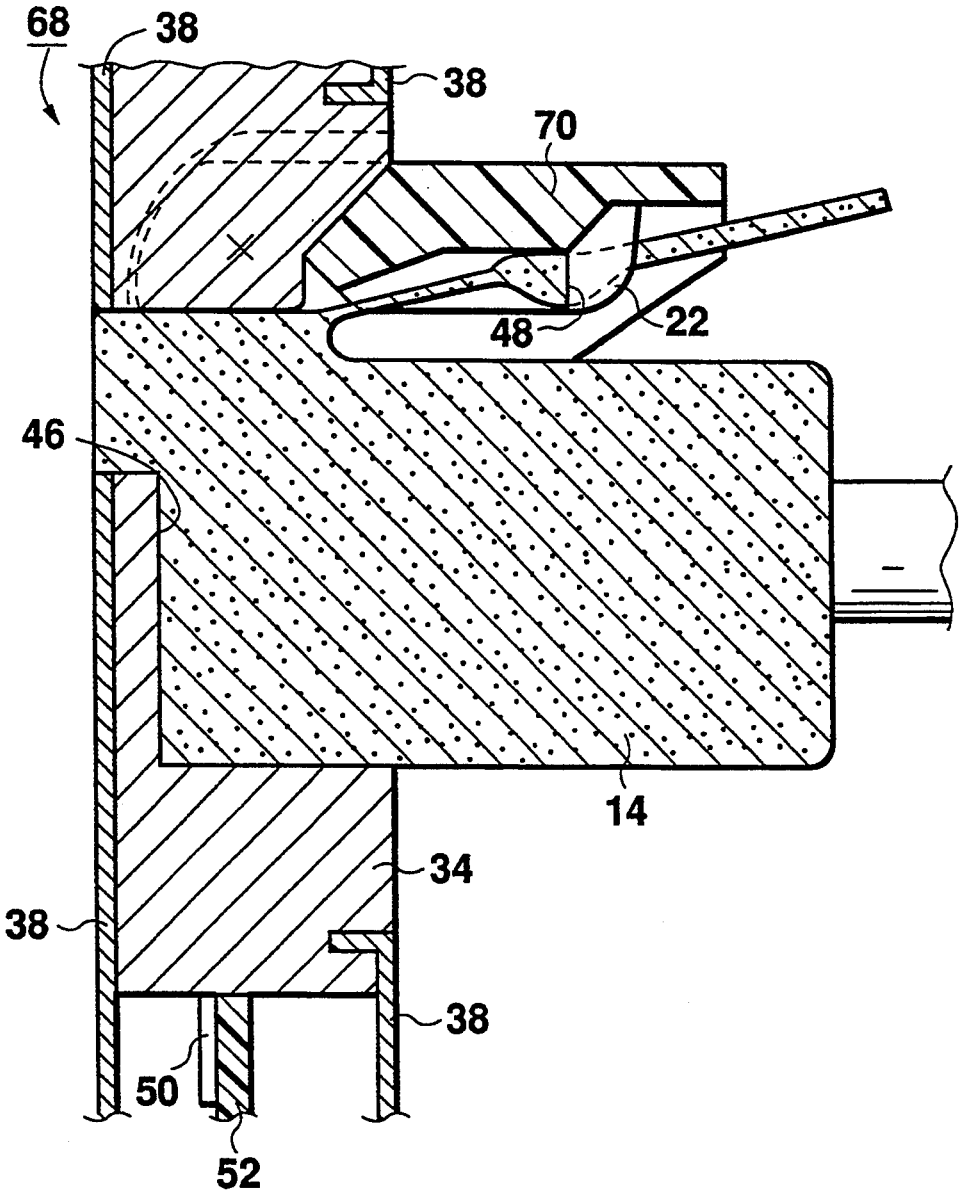
FIG. 14 is a sectional view taken on line F—F of FIG. 12B, and particularly shows the state in which a modular plug is attached to the modular jack.
Figure 15:
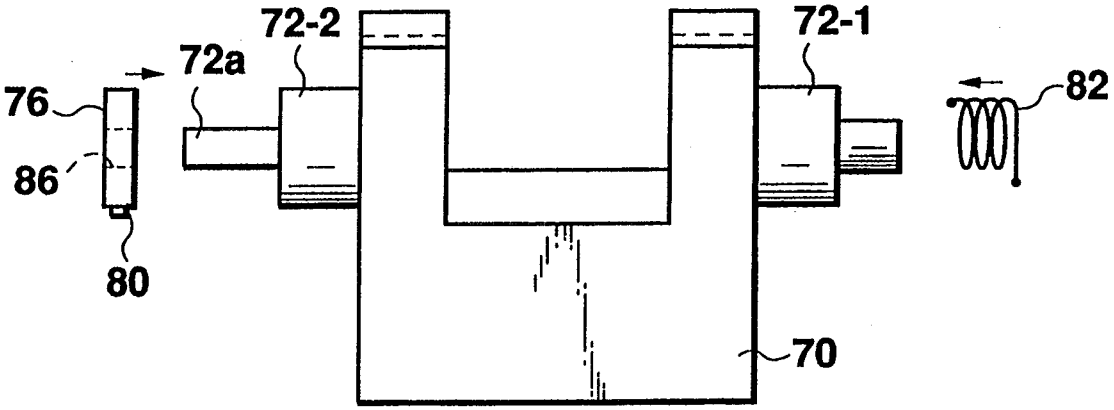
FIG. 15 is a plan view showing the form of the cover of the modular jack in FIG. 12A.
Figure 16:
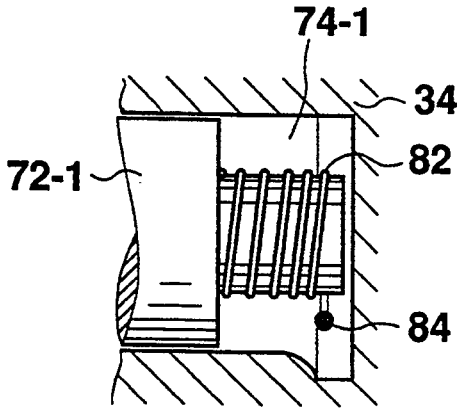
FIG. 16 is a partial sectional view showing the structure of the right end of a shaft of the cover in the fifth embodiment in FIG. 12A when it is built into a flat member.
Figure 17:
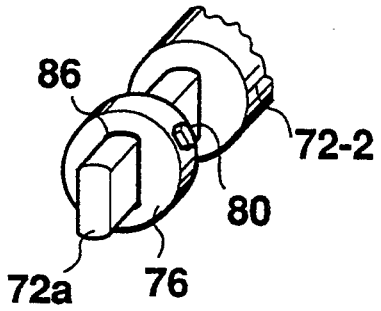
FIG. 17 is a perspective view showing the structure of the left end of the shaft of the cover in the fifth embodiment in FIG. 12A when a sideslip pin is mounted.
Figure 18:
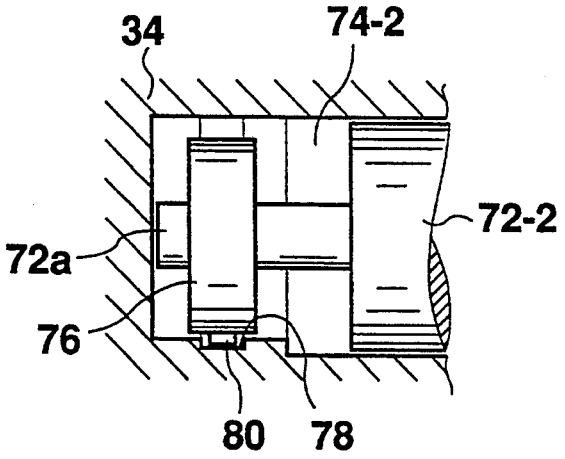
FIG. 18 is a partial sectional view showing the structure of the left end of the shaft of the cover in the fifth embodiment in FIG. 12 when it is built into the flat member.
Figure 19:
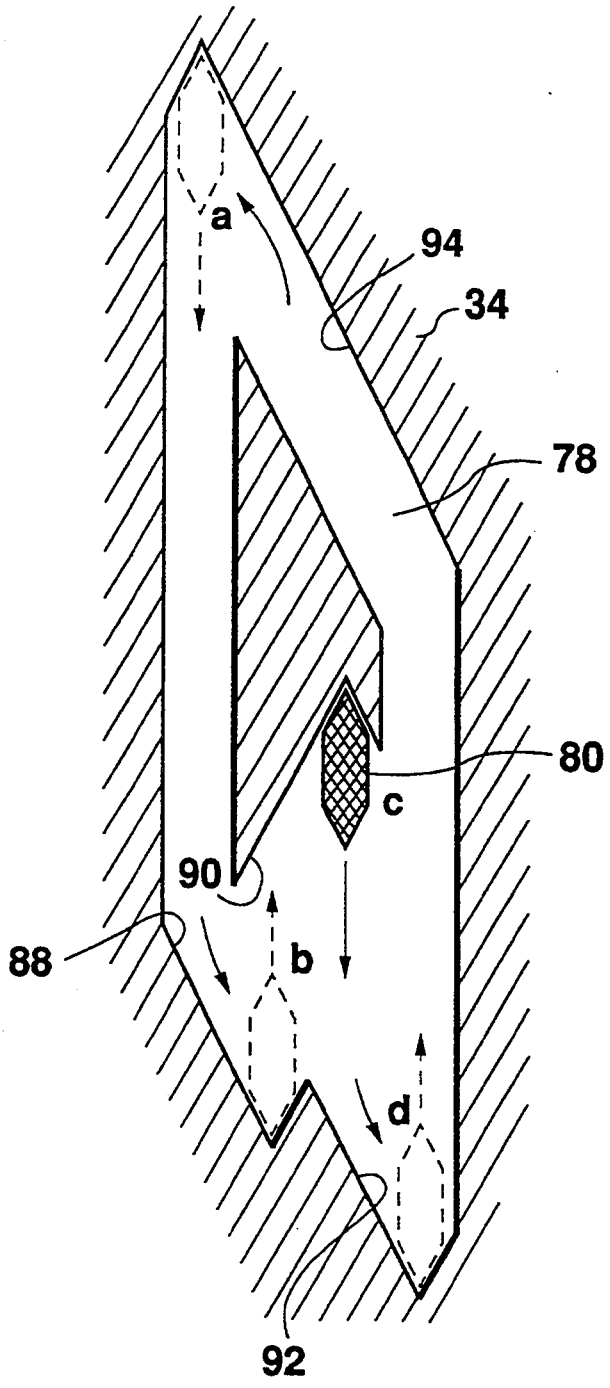
FIG. 19 is a development for illustrating the guide groove development form and pin position transition in the fifth embodiment in FIG. 12A.
Figure 20:
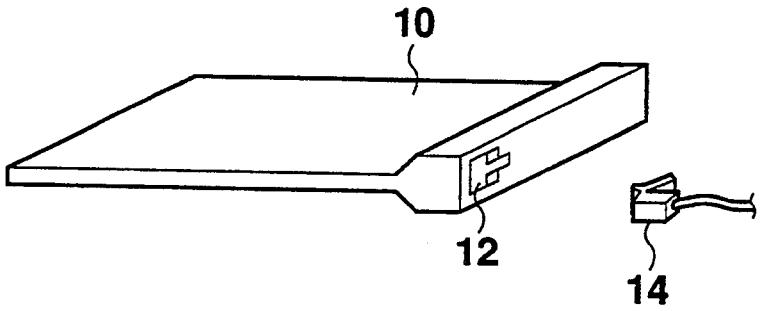
Fig. 20 PRIOR ART
FIG. 20 is a perspective view showing a structure of an IC card having a modular jack according to one conventional embodiment.
Figure 21:
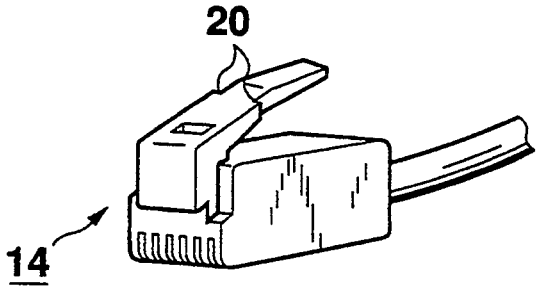
Fig. 21 PRIOR ART
FIG. 21 is an external view showing a form of a modular plug.
Figure 22B:
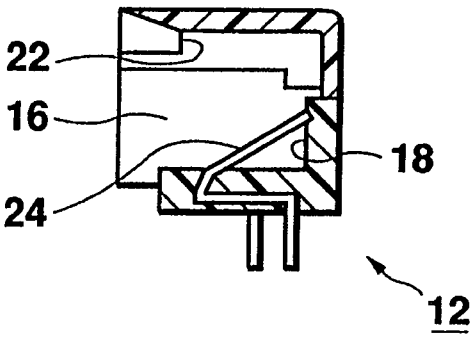
Fig. 22B PRIOR ART
FIG. 22B is a view showing a sectional form taken on line A—A of FIG. 22A.
Figure 22A:
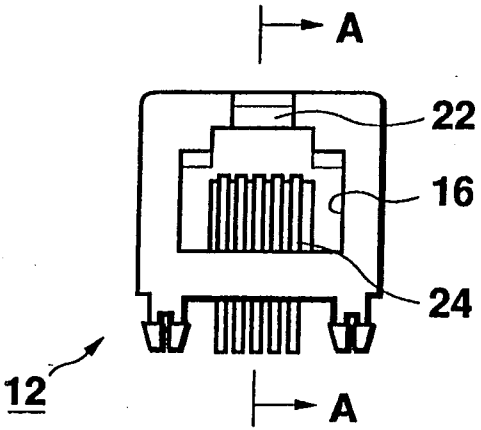
Fig. 22A PRIOR ART
FIG. 22A is a view showing a front form of the modular jack according to the conventional embodiment in FIG. 20.

Next, the structure of a modular jack according to a fifth embodiment of the invention will be described. FIGS. 12A to 19 show the structure of the modular jack 68 according to the fifth embodiment of the invention. FIG. 12A shows the section, taken on line F—F of FIG. 12B, of the modular jack 68 according to the fifth embodiment when a cover 70 is open. FIG. 12B shows the front of the modular jack 68 when the cover 70 is open. FIG. 13A shows the section taken on line F—F of FIG. 13B when the cover 70 is closed. FIG. 13B shows the front of the modular jack 68 when the cover 70 is closed. FIG. 14 shows the section taken on line F—F of FIG. 12B when the cover 70 is open and a modular plug 14 is attached to the modular jack. FIG. 15 shows the exploded view of the cover 70. FIG. 16 shows the form of a pivot 72-1 of the cover 70 when it is built Into a flag member 34. FIG. 17 shows the form of a pivot 72-2 of the cover 70 when a sideslip move pin is mounted. FIG. 18 shows the form of the pivot 72-2 of the cover 70 when it is built in the flat member 34. FIG. 19 is the development of a guide groove 78 and the position transition operation of a pin 80. Parts identical with or similar to those previously described in the first to fourth embodiments are denoted by the same reference numerals in the fifth embodiment and will therefore not be discussed again.

Particularly, as shown in FIGS. 12B, 13B, 15, etc., the pivot 72-1 is drawn out on the right side of the cover 70 and the pivot 72-2 on the left side of the cover 70. The pivots 72-1 and 72-2 are concentric with each other and are housed in holding portions 74-1 and 74-2 of the flat member 34 respectively. Such a structure enables the cover 70 to be rotated, with the axis indicated by the X mark in the figures as the center. In FIGS. 12B and 13B, the internal structures of the pivots 72-1 and 72-2, etc., are not seen because they are covered with one of the metal plates 38.

A spring 82 is mounted on the tip of the pivot 72-1, as shown in FIGS. 15 and 16. The spring 82 is housed in the holding portion 74-1 with it mounted on the cover 70, as shown in FIG. 16. One end of the spring 82 is fixed on a rib 84 disposed in the holding portion 74-1, and the opposite end Is fixed on the pivot 72-1. The holding portion 74-1 is formed like a groove and covered with the metal plates 38. Therefore, when the cover 70 is open, if a force is applied to the cover 70 in the direction indicated by the arrow in FIG. 12A, the spring 82 is wound. Thus, a rotation torque in the direction opposing the force is applied to the cover 70.

On the other hand, the sectional form of the tip **72*a* of the pivot 72-2 is substantially rectangular, as shown in FIGS. 15, 17, and 18. The sideslip pin 76 having a substantially rectangular hole 86 is mounted on the tip 72*a* of the pivot 72-2 by inserting it into the hole 86 of the tip 72*a*. Since the form of both the tip 72*a* and the hole 86 is rectangular, the sideslip pin 76 turns with turning of the pivot 72-2. The sideslip pin 76 has a disk form, and the pin 80 is formed on the circumference of the sideslip pin 76**.

The pivot 72-2 is housed in the holding portion 74-2 like a groove, as shown in FIG. 18. However, since the holding portion 74-2 is covered with the metal plates 38, the internal structure of the holding portion 74-2, etc., is not seen in FIGS. 12B, 13B, etc. An inner wall of the holding portion 74-2 has at least a partially cylindrical form so as to house the sideslip pin. A guide groove 78 is formed on the inner wall of the holding portion 74-2, as shown in FIG. 18. The guide groove 78 has a developed form on the inside of the cyclindrical portion of the holding portion 74-2 as shown in FIG. 19. When the pivot 72-2 is housed in the holding portion 74-2, the pin 80 is guided by the guide groove 78. As the pin 80 moves in the guide groove 78, the sideslip pin 76 moves in the extension direction of the pivot 72-2, namely, in the horizontal direction of FIG. 18.

The fifth embodiment has a feature which enables the cover 70 to be opened or closed by depressing the top of the cover 70 through a single finger motion. The lock and release function is provided by a spring mechanism disposed on the right side of the cover 70 and a guide mechanism disposed on the left side of the cover 70.

As shown in FIG. 19, the guide groove 78 forms one closed channel. The vertical direction of FIG. 19 is the direction around the circumference of the inner wall of the holding portion 74-2. In response to an action against the cover 70, such as depressing, the pin 80 makes the transition through the sequence shown by arrows among the positions indicated by a to d in FIG. 19. When the cover 70 is open as shown in FIGS. 12A, 12B and 14, the pin 80 is urged in the vertical direction of FIG. 19 by the force of the spring 82 transmitted by the body of the pivot 72 and positioned at position a. When the cover 70 is closed as shown in FIGS. 13A and 13B, the pin 80 is driven by the spring 82 and positioned at position c. The position transition of the pin 80 as the cover 70 is handled is described below in more detail.

First, when the cover 70 is open, the pin 80 is positioned at the top end of the guide groove 78, namely, position a. Since a the sideslip pin 76 turns with turning of the pivot 72-2, if a force is applied to the cover 70 in the arrow direction shown in FIG. 12A, the pin 80 moves in the downward direction in FIG. 19 along the guide groove 78. Since the sideslip pin 76 is mounted on the pivot 72 so that it can move horizontally in the extension direction of the pivot 72, when the pin 80 arrives at a lower side 88 of the guide groove 78, the pin 80 is guided by the side 88, thereby moving the sideslip pin 76 in parallel to the right in FIG. 19.

When the pin 80 arrives at position b, if the user handling the cover 70 releases his or her finger from the cover 70, a force exerted by the spring 82 causes the cover 70 to attempt to open. The pin 80 moves in the direction indicated by the broken-line arrow in FIG. 19 from position b, and reaches a side 90 at a certain point in time. When reaching the side 90, the pin 80 is guided by the side 90, thereby moving the sideslip pin 76 in parallel in the right direction in FIG. 19. As a result, the pin 80 reaches position c. At the time, the cover 70 is closed as shown in FIGS. 13A and 13B.

Assume that when the cover 70 is closed, the user depresses the cover 70 in the arrow direction shown in FIG. 13A. Then, the pin 80 at position c moves in the direction indicated by the solid-line arrow in FIG. 19, and reaches a side 92 of the guide groove 78 at a certain point In time and the sideslip pin 76 moves in parallel along the side 92. When the pin 80 reaches the lower end of the guide groove 78, namely, position d, if the used stops depressing the cover 70, a force exerted by the spring 82 causes the pivot 72 to start turning. In this state, there is nothing to hinder the pin 80 from moving, and the pin 80 moves in the guide groove 78 upward in FIG. 19. When the pin 80 reaches an upper side 94 of the guide groove 78, the pin 80 moves in parallel along the side 94 and is restored to position a. In this state, the cover 70 is open as shown in FIGS. 12A, 12B, and 14.

Therefore, in the fifth embodiment, when closing the cover 70, the user needs only to depress the top of the cover 70 until the pin 80 reaches to position b; when opening the cover 70, the user needs only to depress the top of the cover 70 so that the pin 80 reaches position d. That is, the user can open or close the cover 70 through single finger motion; operability is improved.

When the pin 80 is positioned at position a, the cover 70 is held open. This eliminates the need for the user to support the cover 70 with his or her finger when inserting the modular plug 14 into the modular jack 68; operability is also improved by this aspect. In contrast, when the pin 80 is positioned at position c, the cover 70 is held closed. This prevents an accident in which the cover 70 jumps from the hole 36 and is damaged, for example, during transportation. The cover 70 locked in the closed state prevents the invasion of dusts to the hole. The cover 70 prevents the insertion of the fingers of the operator into the hole to avoid the occurrence of the electric shock. Further, when the user attempts to open the cover 70, if no lock/release mechanism exists, he or she must pull up the cover 70 with his or her finger. At this time, there is a possibility that the pivots 72-1 and 72-2, etc., will be destroyed by an unnecessary force applied thereto. In the fifth embodiment, as described above, the user can open or close the cover 70 simply by depressing the surface of the cover 70 through a single finger motion. This prevents an unnecessary force from being applied and a modular jack 68 which is less susceptible to breakdown can be provided.

Sixth Embodiment

The modular jack is located at the center of one end of the IC card in the descriptions given so far, but may be located anywhere.

FIGS. 23A to 24B show the structure of an IC card which differs from that shown in FIGS. 1A to 2. The IC card 96 shown in FIGS. 23A–24B has a hollow flat frame 100 and a case 102 housed in the frame 100. In other words, the frame 100 and the case 102 form a drawer structure. A modular connector 98 according to a sixth embodiment of the invention is formed as a part of the case 102. Therefore, in the embodiment, the modular jack 98 can be housed within the Frame 100. The location of the modular jack 98 also differs from that of the modular jack shown in FIG. 1A, etc.,; the modular jack 98 is disposed at a position offset slightly from the center of one end of the IC card 96.

Figure 23A:
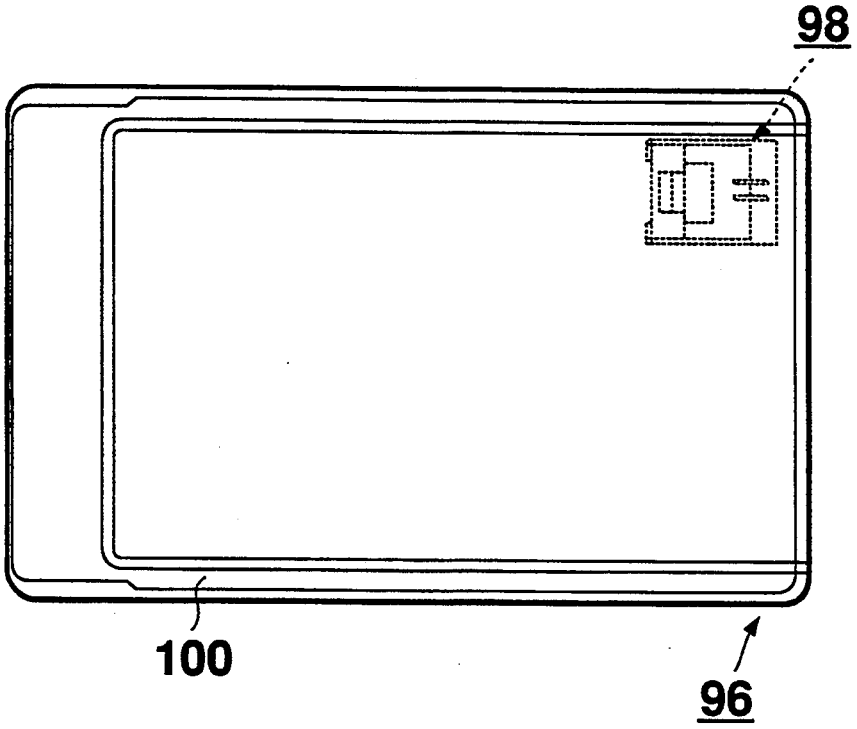
FIG. 23A is a top view of an IC card having a modular jack according to a sixth embodiment of the invention and particularly shows the state in which a modular plug is not attached to the modular jack and the modular jack is housed within the IC card.
Figure 23B:
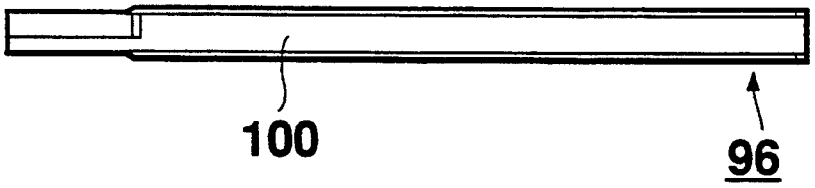
FIG. 23B is a side view of the IC card in FIG. 23A and particularly shows the state in which a modular plug is not attached to the modular jack and the modular jack is housed within the IC card.

Of FIGS. 23A–24B, particularly FIG. 23A is a top view showing the state in which the case 102, therefore the modular jack 98, is housed within the frame 100, and FIG. 23B is a side view thereof. As shown in the figures, the outer dimensions of the IC card 96 are determined substantially by those of the frame 100. The thickness of the frame 100 is determined in response to the "thinness" demanded from the market, for the IC card 96 ("specification or standard"); generally the "thinness" demanded for the IC card 96 is very strict, thus the thickness of the frame 100 is also subject to strict restriction. In the embodiment, the modular jack 98 can also be housed within the frame 100 whose thickness is restricted because the modular jack according to the invention is very thin as seen through the description of the first to fifth embodiments. The sixth embodiment is an embodiment in which the modular jack of the invention having a remarkable advantage of the thin form is coupled with the drawer structure, whereby operability and convenience for handling are improved.

This point is descried in more detail. First, in the embodiment, the modular jack 98 also becomes a flat form with a cover 30 of the modular jack 98 closed. The thickness of the modular jack 98 is set so as to become thinner than the inside measurement space of the frame 100. The dimensions of the case 102 are designed so that the case 102 can be housed completely within the frame 100 designed conforming to predetermined standard dimensions when the cover 30 is closed with a modular plug 14 not attached. Therefore, the IC card 96 in the embodiment can be in size within the predetermined standard by operation of the user whenever the IC card 96 is not used.

Figure 23C:
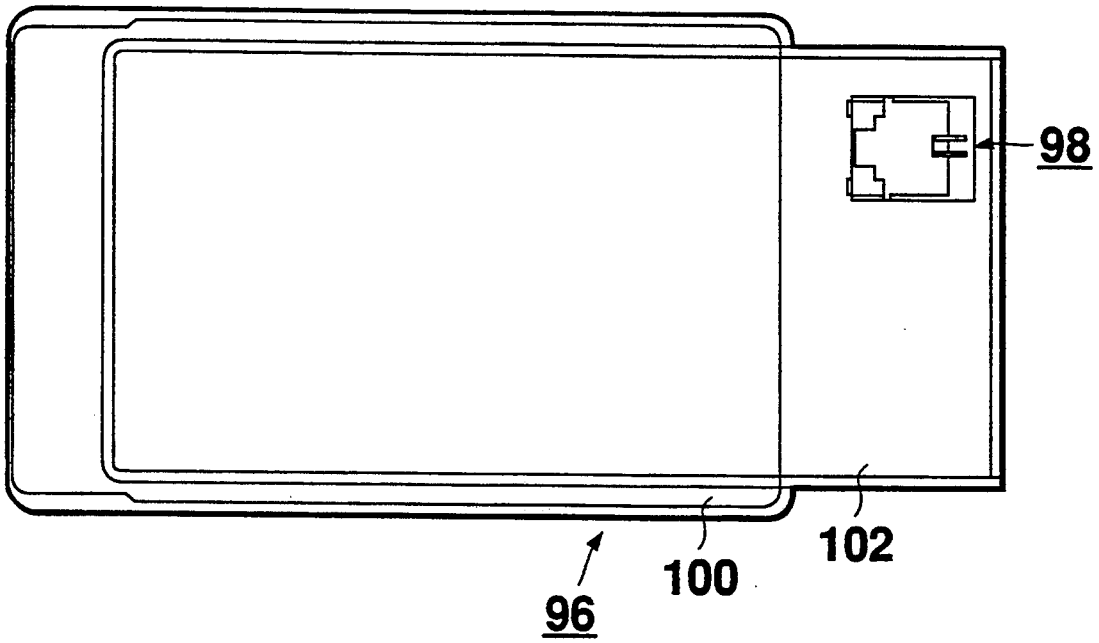
FIG. 23C is a top view of an IC card in FIG. 23A and particularly shows the state in which the modular jack is drawn out to the outside of the IC card and the cover of the modular jack is opened so that a modular plug can be attached to the modular jack.
Figure 23D:
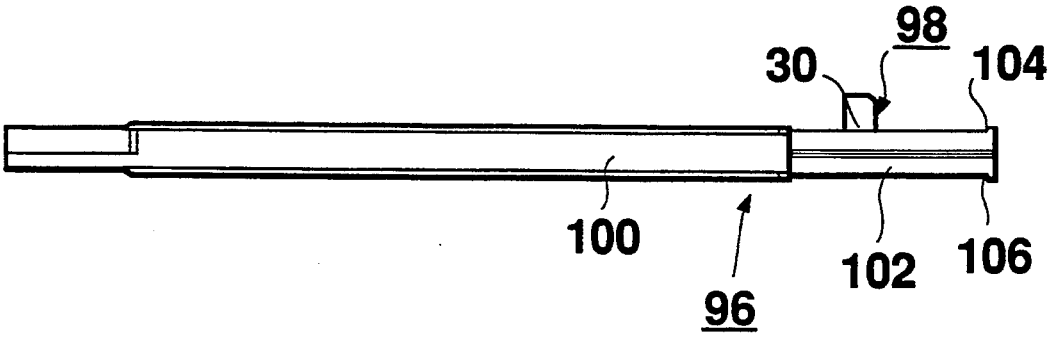
FIG. 23D is a side view of an IC card in FIG. 23A and particularly shows the state in which the modular jack is drawn out to the outside of the IC card and the cover of the modular jack is opened so that a modular plug can be attached to the modular jack.

Of FIGS. 23A–24B, particularly FIG. 23C is a top view showing the state in which the ease 102, therefore the modular jack 98, is drawn out from one end of the frame 100, and FIG. 23D is a side view thereof. The modular jack 98 in the embodiment is formed as a part of the case 102 as described above, and the case 102 is made up of two flat parts, namely, a front case 104 and a rear case 106. The front case 104 and the rear case 106 are engaged with each other or laminated to form one case 102. When the front case 104 and the rear ease 106 are assembled into the case 102, they may be formed as a flat member or a hollow may be produced therewithin. In either the former or latter case, the front case 104 and the rear case 106 must be assembled so that the final case 102 contains a flat portion of a sufficient area to provide the modular jack 98. In the latter case, a circuit board on which circuitry such as a modem making up the IC card 96 is mounted Is housed in the hollow. In the former case, the flat member Is provided with a notch and a space produced by forming the notch is used for allocation of the circuit board. However, the circuit board may be fixed to the frame 100 or the case 102 because the modular jack 98 is connected to the board by a flexible cable 108. (See FIGS. 25A to 27.)

To use the circuitry housed within the IC card 96, more particularly within the case 102 or the frame 100, first the user draws out the case 102 housed in the frame 100 as in FIGS. 23A and 23B with his or her finger, etc. When the case 102 is drawn out from the frame 100, the modular jack 98 appears outside the frame 100. The user then raises the cover 30 of the modular jack 98 with his or her finger, etc. Then, the IC card 96 becomes as shown in FIGS. 23C and 23D. After this, the user can attach the modular plug 14 to the modular jack 98. Therefore, when using the circuitry incorporated in the IC card 98, such as a modem, the user can use the modem simply by drawing out the case 102 and raising the cover 30.

Figure 24A:
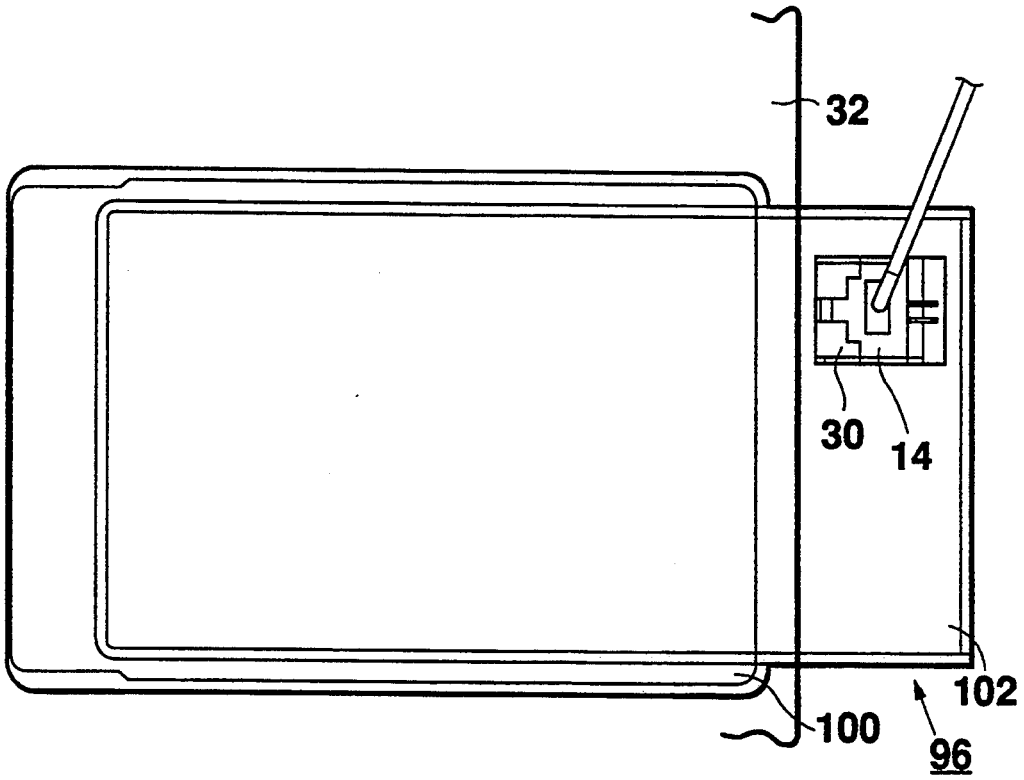
FIG. 24A is a perspective view showing the state in which the IC card in FIG. 23A is installed on an external apparatus and modular plug is attached to modular jack.
Figure 24B:
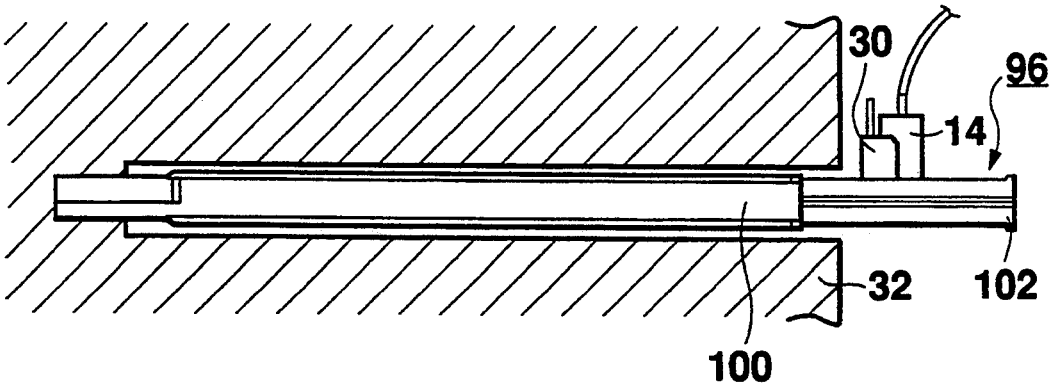
FIG. 24B is a sectional side view showing the state in which time IC card in FIG. 23A is installed on an external apparatus and modular plug is attached to modular jack.

The IC card 96 in the sixth embodiment is also used with it being installed on an external apparatus 32 as in the embodiments described above. Of FIGS. 24A–24B, particularly FIG. 24A is a perspective top view showing the state in which the IC card 96 is installed on the external apparatus such as a personal computer or a wordprocessor, and FIG. 24B is a sectional side view thereof.

To install the IC card 96 on the external apparatus 32, first the user draws out the case 102 from the frame 100, subsequently inserts the IC card 96 into a slit of the external apparatus 32, then raises the cover 30 and attaches the modular plug 14 to the modular jack 98, thereby connecting the modem incorporated in the IC card 96 and a telephone line or the like. Of course, the user may insert the IC card 96 into the slit of the external apparatus 32 after attaching the modular plug 14 to the modular jack 98.

To remove the IC card 96 from the external apparatus 32, the user should perform the following steps before or after drawing out the IC card 96 from the slit: First, the user detaches the modular plug 14 from the modular jack 98. Next, the user throws down the cover 30 to restore the modular jack 98 to the flat form and pushes the ease 102 into the inside of the frame 100. Thus, the IC card 96 becomes the small form as shown in FIGS. 23A and 23B. In this state, the modular jack 98 is not exposed. Therefore, the modular jack 98 is protected from outside dust, etc., and becomes easy to handle for the user.

By the way, the modular jack 98 in the embodiment, whose location is the ease 102 of the structure as described above, does not become the same configuration as in the first to fifth embodiments described above. However, the modular jack 98 in the sixth embodiment can also be made a configuration similar to any of the first to fifth embodiments. For simplicity, in the description to follow, a configuration similar to the first embodiment is adopted as modular jack 98; it will be easy for those skilled in the art to couple a configuration similar to any of the second to fifth embodiments with the drawer structure based on the description of the present specification, etc.

Figure 25B:
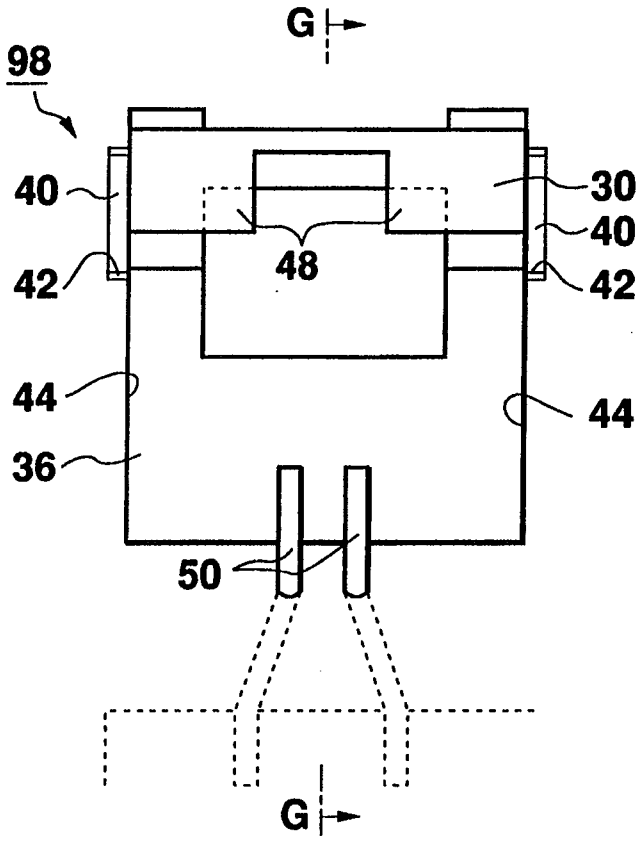
FIG. 25B is a front view of the modular jack according to the sixth embodiment used with the IC card in FIG. 23A, and particularly shows the state in which the cover is open.
Figure 25A:
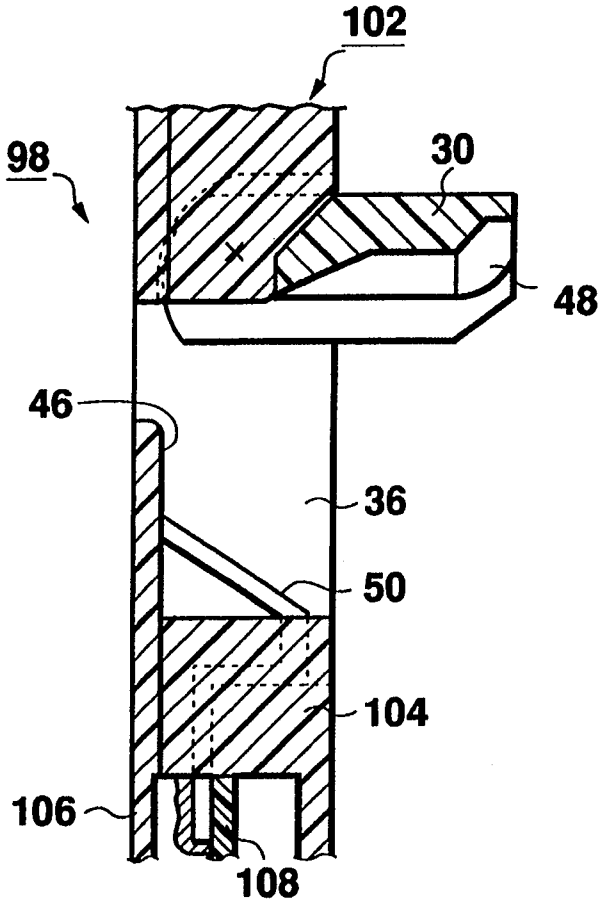
FIG. 25A is a sectional view taken on line G—G of FIG. 25B, and particularly shows the state in which a cover is open.
Figure 26B:
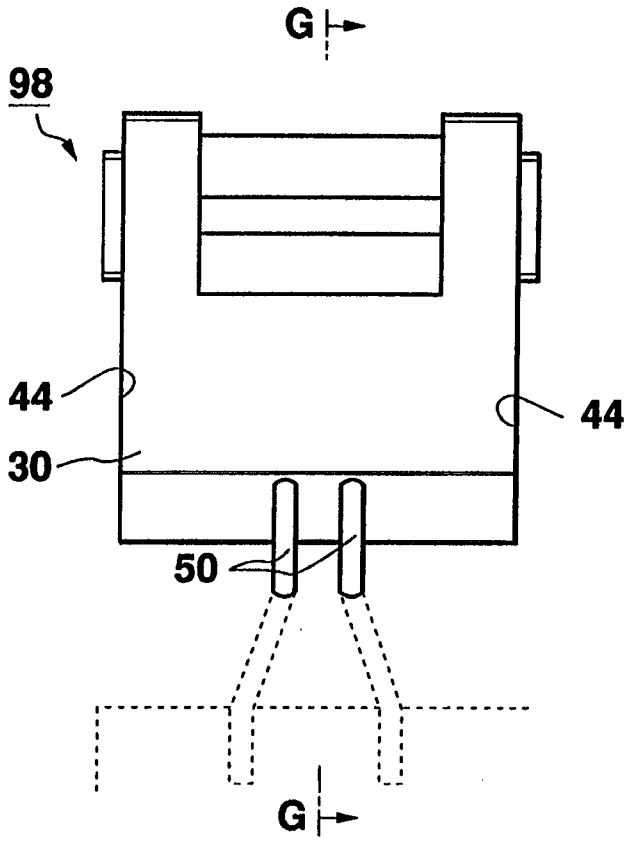
FIG. 26B is a front view of the modular jack according to the sixth embodiment, and particularly shows the state in which the cover is closed.
Figure 26A:
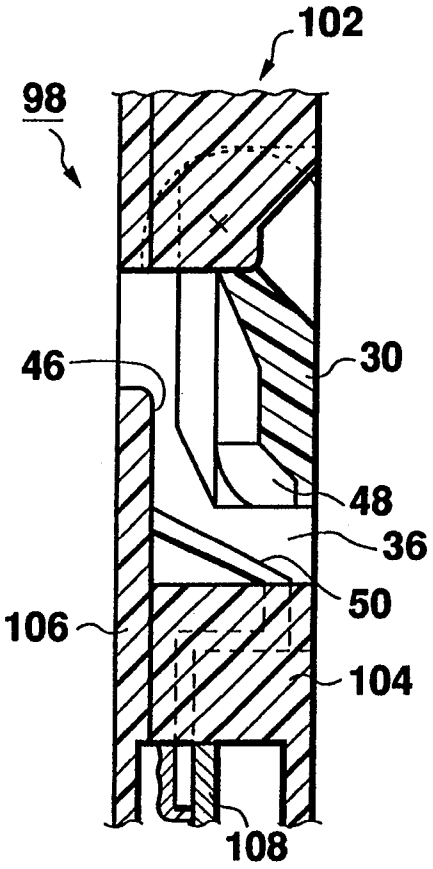
FIG. 26A is a sectional, view taken on line G—G of FIG. 26B, and particularly shows the state in which the cover is closed.
Figure 27:
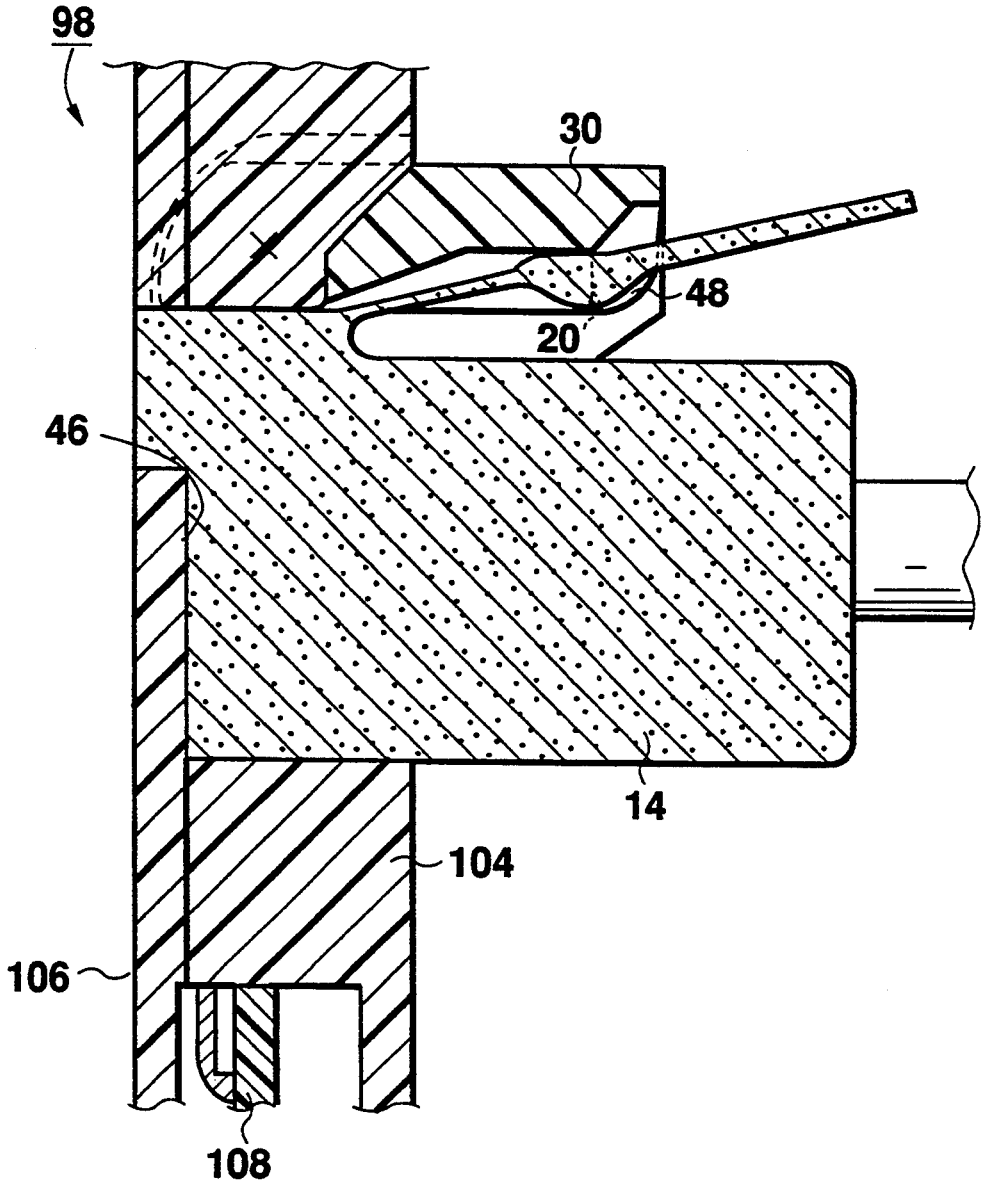
FIG. 27 is a sectional view taken on line G—G of FIG. 25B, and particularly shows the state in which a modular plug is attached to the modular jack.

FIGS. 25A to 27 show the structure of the modular jack 98; FIG. 25A is a sectional view taken on line G—G of FIG. 25B when the cover 30 is open, FIG. 25B is a front view of the modular jack in FIG. 25A, FIG. 26A is a sectional view taken on line G—G of FIG. 26B when the cover 30 is closed, FIG. 26B is a front view of the modular jack in FIG. 26A, and FIG. 27 is a sectional view when the cover 30 is open and further the modular plug 14 is attached.

The differences between the structure in these figures and the structure in the first embodiment are mainly caused by the structural differences at the locations of the modular jacks. First, the modular jack 26 is formed in the flat member 34 in the first embodiment; whereas the modular jack 98 is formed in the case 102 made up of the front case 104 and the rear case 106 in the sixth embodiment. The bottom portion 46 of the modular jack 98 is formed by using the inner surface of the rear case 106.

Further, in the sixth embodiment, the case 102, which is housed in the frame 100, does not require facing or electro-magnetic shielding. Thus, metal plates 38 as disposed on the surface of the flat member 34 are not disposed on the surface of the case 102. In the first embodiment, the metal plates 38 must be formed with an opening within which the modular jack 26 is disposed, but this means is not required in the sixth embodiment.

In the sixth embodiment, electrodes 50 are connected to a modem circuit board (not shown) in the frame 100 by the flexible cable 108. The modular jack 98 and the modem are connected by the flexible cable 108 regardless of whether the case 102 is housed in or drawn out from the frame 100.

Thus, according to the sixth embodiment, effect as in the first embodiment can be provided and remarkable effect of improvement In convenience for handling when the modular jack is not used can be further provided. The sixth embodiment can be manufactured at lower cost than any of the first to five embodiments if the modular jack 98 unit is considered by such fact that working of the metal plates 38 is not required. In addition, the drawer structure adopted in the sixth embodiment can be combined with any of the first to fifth embodiments. When they are combined, the effect of the embodiment according to the combination can also be provided.

Seventh Embodiment

In the sixth embodiment described above, the user must raise or throw down the cover 30 manually. This point can be solved by providing a lock/release mechanism as in the fifth embodiment. In the sixth embodiment, the user must also draw out or push the case 102 from or into the frame 100 manually. This point can be solved by providing a second lock/release mechanism to lock the case 102 for the frame 100 and release it in response to user's operation. Further, these two lock-/release mechanisms can be integrated into one unit.

Figure 28A:
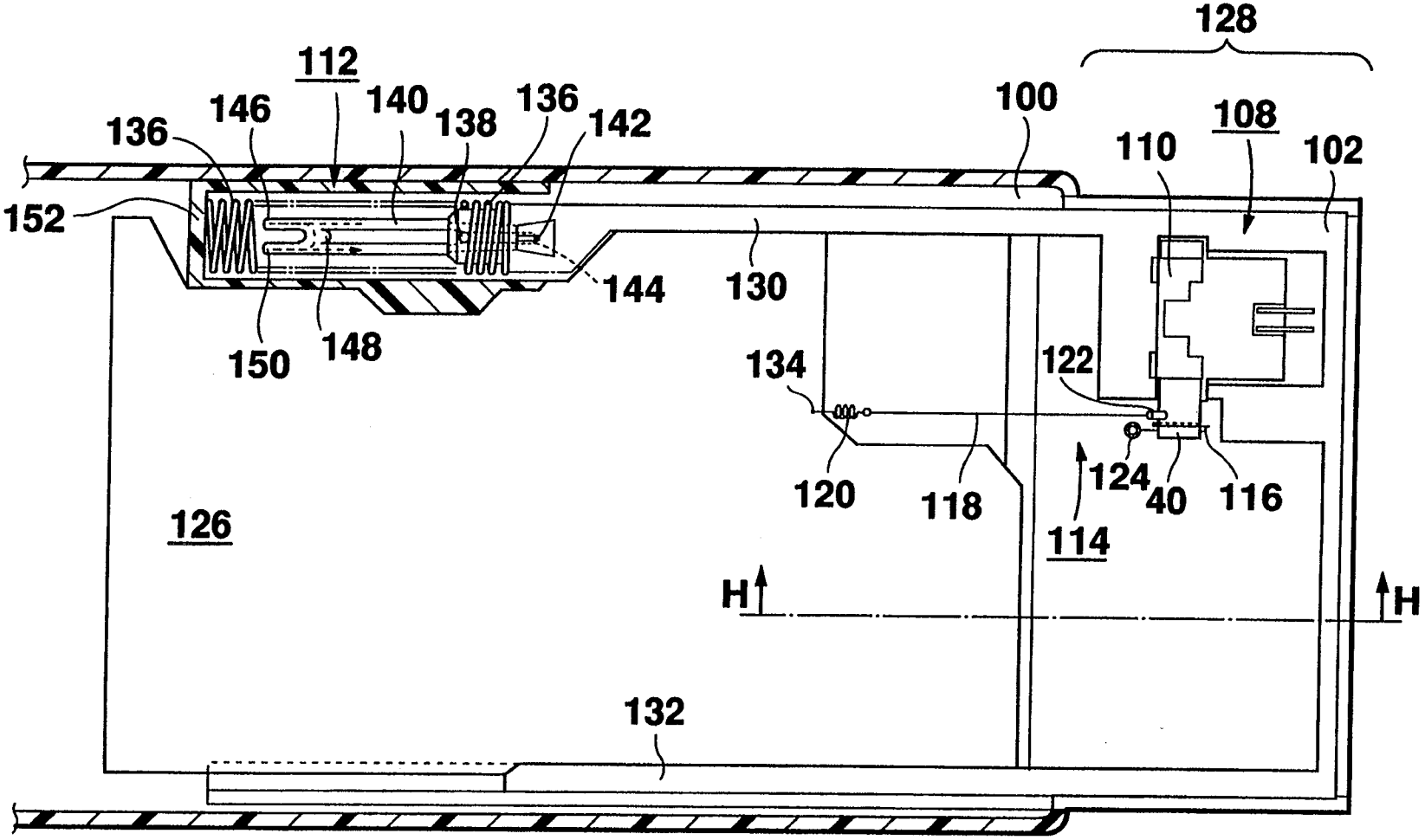
FIG. 28A is a sectional view of an IC card having a modular jack according to a second embodiment of the invention when the IC card is sliced, and particularly shows the state in which the modular jack is drawn out to the outside off the IC card and the cover of the modular jack is opened so that a modular plug can be attached to the modular jack.
Figure 28B:
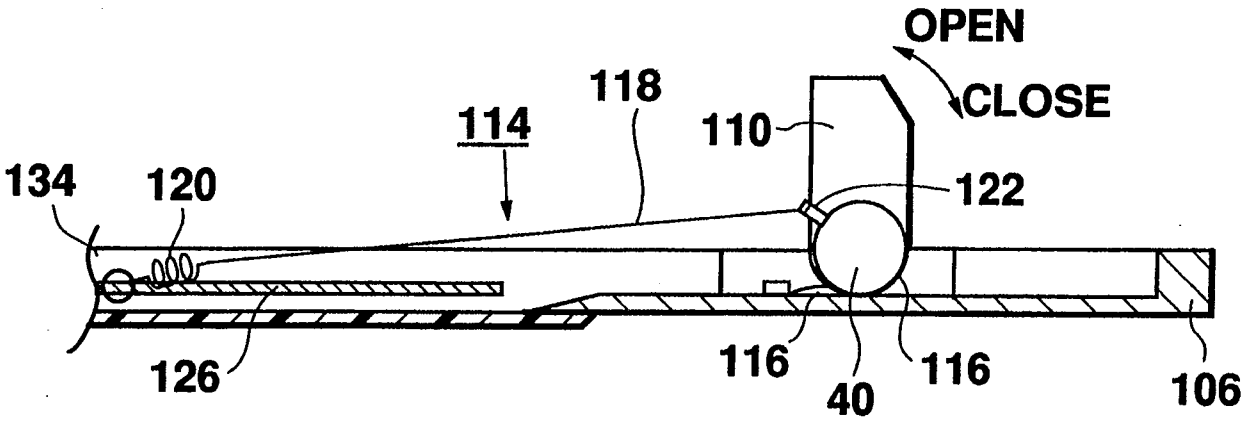
FIG. 28B is a sectional view taken on line H—H of FIG. 28A and further shows the state in which a front case is removed.

FIGS. 28A and 28B show an example in which the two lock/release mechanisms are integrated into one unit. In a seventh embodiment of the invention shown in FIGS. 28A and 28B, if the user pushes one end of a case 102 when the case 102 is housed in a frame 100, a part of the case 102 pops out of the frame 100 and a modular jack 108 is exposed. A cover 110 of the modular jack 108 is opened automatically at the same time as or immidiately after the modular jack 108 appears. In contrast, if the user pushes the case 102 into the frame 100 when a part of the case 102 pops out of the frame 100, the cover 110 is closed automatically in parallel with pushing the case 102. FIG. 28A is a partial sectional view showing the slate in which the frame 100 is sliced in the thickness direction. FIG. 28B is a sectional view taken on line H—H of FIG. 28A when a front case 104 is removed. Referring to these figures, the modular jack 108 in the seventh embodiment, particularly a lock-/release mechanism thereof is described in detail.

First, a circuit board 126 is disposed within the frame 100 as shown in FIG. 28A. It is a board on which circuits such as a modem as described in the preceding embodiments are mounted. The circuit board 126 is fixed to the frame 100 at a place hidden in the figure. The case 102 has a projection 128 where the modular jack 108 is formed and which pops out of the frame 100 when the modular jack 108 is used, and arms 130 and 132 projected from the upper and lower ends to left of the projection 128 in the figure. Each of the arms 130 and 132 sandwiches slidably the corresponding end of the circuit board 126 in the figure. Therefore, when the case 102 is moved in the left direction in the figure by the user, namely, is pushed into the frame 100, it is guided by both the upper and lower ends of the circuit board 126. Likewise, when the case 102 is popped out of the frame 100 by the user, It is guided by both the upper and lower ends of the circuit board 126.

A rear case 106 is disposed extending from top to bottom of the projection 128, but a front case 104 is broken away except the portion required to locate the modular jack 108. This point is seen by comparing FIGS. 28A and 28B. A notch corresponding to the formation portion of the modular jack 108 is formed in the upper right end of the circuit board 126. In other words, the front case 104 has the form as described above to avoid confliction with the circuit board 126 and provide the effective area of the circuit board 126.

The lock/release mechanism in the seventh embodiment consists roughly of a spring mechanism 112 formed by using the arm 130 having the form as described above and an opening/closing mechanism 114 formed by using the circuit hoard 126 and the projection 128.

The opening/closing mechanism 114 is a mechanism for automatically opening the cover 110 when the case 102 is drawn out from the frame 100 and for automatically closing the cover 110 when the case 102 is housed within the frame 100. Therefore, it is a mechanism following the spring mechanism 112. The opening/closing mechanism 114 has a holder spring 116, a wire 118, and a wire-end spring 120.

The holder spring 116 is a spring wound around a pivot 40 of the modular jack 108. One end of the holder spring 116 is fixed to the pivot 40 and the other end to a predetermined place 124 of the rear case 106 by the well known method. The holder sprint 116 energizes the cover 110 in the closing direction thereof.

The wire 118 links the cover 110 and the frame 100. One end of the wire 118 is fixed to a pin 122 disposed on the pivot 40 and the other end is fixed to the circuit board 126 by using a hole 134 formed on the circuit board 126 and via the wire-end spring 120. The wire 118 pulls the cover 110 toward the open side around the pivot 40 against energy of the holder spring 116. The wire-end spring 120 is a buffer member between the wire 118 and the circuit board 126. Of course, the wire 118 may be fixed via the wire-end spring 120 to the frame 100 rather than to the circuit board 126.

The operation of the opening/closing mechanism 114 is described in detail.

First, when the case 102 is housed In the frame 100, the tension is not applied to the wire 118, and the cover 110 is kept closed by energy of the holder spring 116. When the user pushes one end of the case 102 and therefore the case 102 is drawn out from the frame 100, the wire 118 is strained, thereby pulling the cover 110 in the open direction thereof. Therefore, the cover 110 is automatically opened in response to pushing by the user, i.e., to drawing out the case 102 from the frame 100. The user can attach a modular plug 14 to the modular jack 108 without handling the cover 110.

In contrast, if the user houses the case 102 in the frame 100 when the case 102 is drawn out, strain of the wire 118 is released, thereby applying no pulling force to the cover 110. Resultantly, the cover 110 is automatically closed by energy of the holder spring 116. The user can house the case 102 in the frame 100 without handling the cover 110.

Thus, in the embodiment, as the user draws out and houses the case 102, the state transition of the IC card is automatically made between the drawing out state in which the modular plug 14 can be connected and the state in which the modular jack 108 is housed in the case 102. Such easy operation is enabled by the opening/-closing mechanism 114. However, the effect depends on the drawing out operation and housing operation of the case 102, and is dependent movement in the sense.

The spring mechanism 112 is a mechanism related to the drawing out operation and housing operation of the case 102. First, the spring mechanism 112 has a function of holding the state in which the case 102 is drawn out from the frame 100 and the state in which the case 102 is housed in the frame 100. Second, it has a function of moving the case 102 so as to make the transition to the state in which the case 102, in its turn the modular jack 108 is drawn out to the outside of the frame if the user pushes one end of the case 102 in the inside direction of the frame 100 when the case 102 is housed in the frame 100.

As shown in FIG. 28A, the spring mechanism 112 has a coil spring 136, a key spring 138, and a guide groove 140. One end of the key spring 138 is held at the tip of the arm 130 (where leader is drawn in FIG. 28A). The other end 142 of the key spring 138 moves within the guide groove 140 forming two circular paths of 144→146→148→150→144 and 144→150→148→146→144 in the figure in response to operation of the user. The coil spring 136 holds the tip of the arm 130 and is housed in a chamber 152 formed in the frame 100.

Assume that the user pushes one end of the case 102 (the right end in the figure) when the case 102 pops out to the outside of the frame 100. Then, the coil spring 136 is compressed by the arm 130 and the key spring 138 drags. The tip 142 of the key spring 138 starts moving within the guide groove 140. At the point in time, the tip is guided in the direction of either of overroutes 146 and 150 (146 if the arrow in the figure is followed) .

If the user releases his or her hold of the case 102, the coil spring 136 is released from being compressed by the arm 130. Assuming that the tip 142 of the key spring 138 has already entered either the overroute 146 or 150 at the point in time, releasing the coil spring 136 from compression causes the tip 142 of the key spring 138 to move to a stop position 148 because the key spring 138 is energized in the center line direction of the coil spring 136 by elastic force of the key spring 138. In the state, the tip 142 of the key spring 138 is locked at the stop position 148, thus the case 102 does not pop out from the frame 100 although the user releases his or her hold of the case 102 and although it is energized by the coil spring 136 in the right direction in the figure. In such a manner, the state in which the case 102 is housed in the frame 100 is set.

Assume that when the case 102 is housed in the frame 100, the user pushes one end of the case 102 (the eight end in the figure). Then, the coil spring 136 is compressed by the arm 130 and the key spring 138 drags. The tip 142 of the key spring 138 restarts moving within the guide groove 140. At the point in time, the tip is guided in the direction of either of overroutes 146 and 150 (150 if the arrow in the figure is followed) .

If the user releases his or her hold of the case 102, the coil spring 136 is released from being compressed by the arm 130. Assuming that the tip 142 of the key spring 138 has already exited from the overroutes 146 and 150 at the point in time, releasing the coil spring 136 from compression causes the tip 142 of the key spring 138 to move to a stop position 144 because the case 102 is energized by the coil spring 136 in the right direction in the figure and because the key sprint 138 is energized in the center line direction of the coil spring 136 by elastic force of the key sprint 138. In such a manner, the state in which the case 102 pops out from the frame 100 is set.

Bear in mind that the opening/closing mechanism 114 described above also operates in conjunction with the spring mechanism 112. That is, both the mechanisms 112 and 114 operate with "push" operation of one end of the case 102 as a trigger, and function mainly owing to the structure of the cover 110; both as a unit improve operability remarkably.

The lock/release mechanism is not limited to the opening/closing mechanism 114 and the spring mechanism 112 in the embodiment, and all existing lock-/release mechanisms can be adopted.

Thus, when the modular plug 14 is not connected, the case 102 can be housed completely in the frame 100 in the modular jack housing structure in the embodiment. Therefore, when the modular jack 14 is not connected, the case 102 does not stick out from IC card, and the modular jack 108 can always be housed completely within the IC card designed conforming to the predetermined standard, thereby eliminating inconvenience of handling the IC card. Since additional discrete parts need not be used, inconvenience caused by losing parts is also eliminated.

According to the invention, the flat member is formed with a hole, and a cover that can be opened and closed is provided which is housed in the hole when it is closed and locks a modular plug when it is open, thus the modular jack containing the cover can be made thinner for application to IC cards, etc. As a result, the modular jack becomes easy to handle and production costs are reduced. Engagement projections or recesses, if provided, hold the cover state, thus providing a modular jack which is less likely to become damaged and is high in operability. Further, the lock/release mechanism, if provided, enables the user to open or close the cover through a single finger motion, thus providing a modular jack which is less prone to damage and is improved in operability.

Further, the drawer structure where a case is housed within a flat frame having an opening at one end face so that it can be drawn out is adopted and a flat modular jack is disposed near the end face of the case. Thus, even if the frame is prepared with strict standard dimensions, it can be within the standard dimensions when the modular jack is not used.

What is claimed is:

1. A modular jack for connection to a modular plug, the modular plug having a tip and electrodes and being insertable into the jack by movement in an insertion direction into an inserted position, said modular jack comprising:

a flat member having first and second opposed major faces and having a hole that extends between, and forms an opening at, each of said first and second major faces, said hole being delimited by inner walls formed in said flat member for guiding insertion movement of the plug and a bottom portion, adjacent said second major face, against which the tip of the plug abuts when the plug is in the inserted position;

an electrode section located in said hole so as to be electrically connected to electrodes of the modular plug when the modular plug is inserted into said hole through said opening; and a cover mounted to said flat member for movement between an open position in which said opening is uncovered for insertion of the plug into said jack and a closed position in which said cover is housed in said hole and covers said opening, said cover being formed to prevent a user's fingers from contacting said electrode section and to impede entry of dust into said hole when said cover is in the closed position, said cover having a hook portion for releasably locking the plug in the inserted position.

2. The modular jack as claimed in claim 1 wherein:

said flat member has first and second projections and said cover has a third projection; and said projections are arranged such that when said cover is in the open position, said first projection is engaged with said third projection to maintain said cover in the open position, and when said cover is in the closed position, said second projection is engaged with said third projection to maintain said cover in the closed position.

3. The modular jack as claimed in claim 1 wherein said flat member has first and second recesses and said cover has a projection; and said recesses and projection are arranged such that when said cover is in the open position, said projection is fitted into said first recess to maintain said cover in the open position, and when said cover is in the closed position, said projection is fitted into said second recess to maintain said cover in the closed position.

4. The modular jack as claimed in claim 1 wherein said flat member has first and second projections and said cover has a recess; and said projections and said recess are arranged such that when said cover is in the open position, said first projection is fitted into said recess to maintain said cover in the open position, and when said cover is in the closed position, said second projection is fitted into said recess to maintain said cover in the closed position.

5. The modular jack as claimed in claim 1 further comprising a first lock/release mechanism for maintaining said cover in the open position or the closed position, said mechanism being operative, when said cover is in the closed position, in response to depression of said cover, for moving said cover to the open position.

6. The modular jack as claimed in claim 5 wherein said first lock/release mechanism comprises:

first and second pivots pivotable about a common pivot axis and fixed to said cover;

spring means for applying a torque around said first pivot on said cover to turn said cover around said first and second pivots; and guide means for guiding said cover between the open and closed positions in response to turning of said cover around said second pivot.

7. The modular jack as defined in claim 6 wherein said spring means includes a spring wound on said first pivot, said spring having two ends, one of which is fixed on said flat member and the other one of which is fixed on said cover.

8. The modular jack as claimed in claim 6 wherein said guide means comprise:

a movable member disposed to be movable along the common pivot axis and pivotable with said second pivot as said cover turns around said second pivot;

a pin disposed on a circumference of said movable member; and guide means formed in said flat member for receiving and guiding said pin;

wherein said guide means have at least two stable holding points for holding said pin at a predetermined position unless a force in opposition to the torque exerted by said spring means is applied to said cover, said stable holding points corresponding to the cover open position and the cover closed position.

9. The modular jack as claimed in claim 1 further including a conductive member on one of said major faces of said flat member, said conductive member surrounding said hole.

10. The modular jack as claimed in claim 1 wherein said electrode section comprises springy electrode members.

11. The modular jack as claimed in claim 1 wherein: said flat,member is configured to be installed in a fixed position in a piece of equipment; said flat member has a portion which projects out of the piece of equipment when said flat member is installed in the piece of equipment; said hole is located in said portion of said flat member; and said inner walls of said hole extend perpendicularly to said first and second opposed major faces of said flat member.

12. The modular jack as claimed in claim 11 wherein said portion of said flat member is delimited by a rear edge of said flat member and two side edges which extend to said rear edge and are oriented to form chamfered corners of said flat member.

13. The modular jack as claimed in claim 1 wherein said hole additionally forms a second opening at said second major face, and said cover extends across the entirety of said second opening when said cover is in the closed position.

14. The modular jack as claimed in claim 1 further comprising: a circuit housed in said flat member, and conductive plates covering said major faces of said flat member for electromagnetically shielding said circuit.

15. The modular jack as claimed in claim 14 wherein said electrode section is electrically connected to said circuit.

16. A flat-packaged assembly comprising:

a modular jack as defined in claim 1; and a frame member enclosing a housing region in which said modular jack is mounted, said modular jack being movable relative to said frame member between a retracted position in which said modular jack is covered by said frame member and an extended position in which said hole is outside of said housing region, said modular jack being movable to said retracted position only when said cover is in the closed position.

17. The assembly as claimed in claim 16 wherein said flat member comprises a first case member and a second case member, each of which is flat and has a first face and a second face, and said first face of said first case member faces said first face of said second case member.

18. The assembly as claimed in claim 17 wherein said hole is formed at least in said first case member and wherein said cover is mounted on said first case member.

19. The assembly as claimed in claim 17 wherein said bottom portion is composed of a part of the first face of said second case member.

20. The assembly as claimed in claim 16 further comprising:

a spring mechanism coupled between said modular jack and said frame member and having a first state and a second state, said mechanism effecting automatic state transition between the first and second states in response to operation by a user, said first state being a state in which said hole is disposed outside of said housing region;

said second state being a state in which said hole is disposed completely inside said housing region;

the operation by the user for causing said transition to be made being an operation of applying pressure to said flat member in a direction to push said flat member.

21. The assembly as claimed in claim 16 further comprising:

an opening/closing mechanism for automatically moving said cover to the open position after movement of said modular jack away from the retracted position by a distance sufficient to place said hole outside of said housing region and for automatically moving said cover to the closed position during movement of said modular jack to said retracted position from a position in which said hole was outside of said housing region.

22. The assembly as claimed in claim 21 further comprising:

a spring mechanism coupled between said modular jack and said frame member and having a first state and a second state, said mechanism effecting automatic state transition between the first and second states in response to operation by a user, said first state being a state in which said hole is disposed outside of said housing region;

said second state being a state in which said hole is disposed completely inside said housing region;

the operation by the user for causing said transition to be made being an operation of applying pressure to said flat member in a direction to push said flat member.

23. The assembly as claimed in claim 22 wherein said hole is located in a first portion of said flat member, and said flat member has a second portion comprising a guide which cooperates with said frame member for guiding movement of said modular jack between said retracted and extended positions.

24. The assembly as claimed in claim 23 wherein said spring mechanism comprises:

a first spring having a first end fixed to said frame member and a second end fixed to said second portion of said flat member;

a second spring having a first end fixed to said second portion of said flat member and a second end which is slidable relative to said frame member; and guide means for guiding movement of said second spring, said guide means having a first stop position for holding said second end of said second spring so that said spring mechanism is held in said first state, and a second stop position for holding said second end of said second spring so that said spring mechanism is held in said second state, and said guide means providing at least one path for guiding said second end of said spring to effect transition between said first and second states.

25. The assembly as claimed in claim 24 wherein said opening/closing mechanism comprises:

a third spring having a first end fixed to said first portion of said flat member and a second end fixed to said cover and operable in a direction for moving said cover to the closed position; and a wire having a first end fixed to said cover and a second end fixed relative to said frame member for pulling in a direction for moving said cover to the open position.

26. The assembly as claimed in claim 25 further comprising a circuit board containing electric circuitry, said circuit board being fixed to said frame member and to said second end of said wire.

* * * * *